US006560955B1

(12) United States Patent
Chia et al.

(10) Patent No.: US 6,560,955 B1
(45) Date of Patent: May 13, 2003

(54) JEWELRY ROPE CHAIN LINK ELEMENT

(76) Inventors: Meang K. Chia, 412 W. 6th St., Suite 1104, Los Angeles, CA (US) 90014; Cheo K. Chia, 412 W. 6th St., Suite 1104, Los Angeles, CA (US) 90014; Huy K. Chia, 412 W. 6th St., Suite 1104, Los Angeles, CA (US) 90014

( * ) Notice: Subject to any disclaimer, the term of this patent is extended or adjusted under 35 U.S.C. 154(b) by 0 days.

(21) Appl. No.: 09/337,455

(22) Filed: Jun. 21, 1999

Related U.S. Application Data

(63) Continuation-in-part of application No. 09/287,972, filed on Apr. 7, 1999.

(51) Int. Cl.[7] ..... B21L 5/02

(52) U.S. Cl. ..... 59/80; 59/82; 59/35.1; D11/13

(58) Field of Search ..... 59/80, 82, 35.1; D11/13

(56) References Cited

U.S. PATENT DOCUMENTS

| | | | | |
|---|---|---|---|---|
| 848,299 | A | 3/1907 | Feid | |
| 1,055,751 | A | 3/1913 | Hurley | |
| 1,886,784 | A | 11/1932 | Roppenhausen | |
| 4,348,861 | A | 9/1982 | Nakagawa | 59/82 |
| 4,493,183 | A | 1/1985 | Bucefari et al. | 59/16 |
| 4,651,517 | A | 3/1987 | Benhamou et al. | |
| 4,679,391 | A | 7/1987 | Tizzi | 59/20 |
| 4,934,135 | A | 6/1990 | Rozenwasser | |
| D313,372 | S | 1/1991 | Kulla | |
| D313,771 | S | 1/1991 | Kulla | |
| 4,996,835 | A | 3/1991 | Rozenwasser | |

(List continued on next page.)

FOREIGN PATENT DOCUMENTS

| | | |
|---|---|---|
| EP | 0 470 937 | 2/1992 |
| FR | 2 446 612 | 8/1980 |

OTHER PUBLICATIONS

All Karats International, Edizioni, Primavera–Estate/*Spring–Summer*, Sixth Edition, Two–tone Diamond Cut Rope Chain; 2 pages (1998).

K Mart, Item #76617103508, Sterling Silver Two–tone Solid Diamond Cut Rope Chain; 3 pages.

*JO Magazine*; "Images From our exciting new collection"; 1 page total.

QVC, Item #J64656, 36" Two–tone Solid Rope Necklace, 14K Gold 7.5 grams; 2 pages.

Filk SPA–Catene, Via S. Giuseppe, 10–36065 Mussolente (Vicenza) Italy, 2 pages.

Armburst Chain Co. Catalog, 735 Allens Ave., Providence, RI 02905, 1975, p. 15, 145,151, and 188.

L'Oromeccanica, Via Marchesane 115A/36061 Bassano Del Grappa (Vicenza) Italy, 1982, 2 pages.

Aurora, Via Vecchia Ferriera 70, 36100 Vicenza, Italy, 1997.

*Primary Examiner*—David Jones
(74) *Attorney, Agent, or Firm*—Ladas & Parry

(57) ABSTRACT

A decorative rope chain and a manufacturing process to produce a rope chain in which each link element used as a basic building element exhibits a unique visual property, such as surface texture, coloration, attribute, feature, characteristic, shape or other physical appearance. Such unique visual property traits for the succession of link elements results in a more attractive, fanciful, more delicate and interesting fashion item. Each of the interconnected link elements may have a first major surface exhibiting a first visual property and an opposite second major surface exhibiting a second, perceptively different, visual property. In other aspects of the invention, the major surfaces of the link elements may have differently colored or textured surface portions. In yet another aspect of the invention, each link element may have differently shaped portions. Similarly, the interior and/or exterior edges of the link element may exhibit different shapes, colors, patterns, or textures.

82 Claims, 10 Drawing Sheets

U.S. PATENT DOCUMENTS

| | | | | |
|---|---|---|---|---|
| D321,148 | S | 10/1991 | Chiaramonti et al. | D11/12 |
| D326,065 | S | 5/1992 | Borgogni | |
| 5,125,225 | A | 6/1992 | Strobel | |
| 5,129,220 | A | 7/1992 | Strobel | 59/80 |
| D329,828 | S | 9/1992 | Bedoyan | |
| D330,175 | S | 10/1992 | Kahan | D11/13 |
| D330,343 | S | 10/1992 | Bedoyan | |
| 5,185,995 | A | 2/1993 | Dal Monte | |
| D335,834 | S | 5/1993 | Grotto | |
| D340,422 | S | 10/1993 | Grando | |
| D343,136 | S | 1/1994 | Grando | |
| D343,806 | S | 2/1994 | Bedoyan | |
| 5,285,625 | A | 2/1994 | Ofrat et al. | |
| 5,301,498 | A | 4/1994 | Chia et al. | |
| 5,303,540 | A | 4/1994 | Rozenwasser | 59/80 |
| 5,309,704 | A | 5/1994 | Grando | |
| 5,339,655 | A | 8/1994 | Grando | |
| 5,353,584 | A | 10/1994 | Strobel et al. | |
| 5,361,575 | A | 11/1994 | Rozenwasser | |
| D353,556 | S | 12/1994 | Chia et al. | |
| 5,408,820 | A | 4/1995 | Strobel et al. | |
| 5,412,935 | A | 5/1995 | Rozenwasser | 59/80 |
| D359,010 | S | 6/1995 | Rozenwasser | |
| 5,425,228 | A | 6/1995 | Hillel | |
| 5,437,149 | A | 8/1995 | Strobel | |
| D362,203 | S | 9/1995 | Grando | |
| 5,452,572 | A | 9/1995 | Alvaro et al. | |
| 5,471,830 | A | 12/1995 | Gonzales | |
| 5,487,264 | A | 1/1996 | Strobel | |
| D368,048 | S | 3/1996 | Rozenwasser | |
| D370,184 | S | 5/1996 | Rozenwasser | |
| D370,426 | S | 6/1996 | Rozenwasser | |
| 5,526,639 | A | 6/1996 | Gonzales | |
| 5,531,065 | A | 7/1996 | Rozenwasser | |
| 5,537,812 | A | 7/1996 | Rozenwasser | |
| 5,542,244 | A | 8/1996 | Chia et al. | |
| 5,544,477 | A | 8/1996 | Rozenwasser | 59/13 |
| D376,119 | S | 12/1996 | Rozenwasser | D11/13 |
| 5,581,993 | A | 12/1996 | Strobel | |
| 5,626,012 | A | 5/1997 | Fabbro | |
| 5,653,100 | A | 8/1997 | Dal Monte | |
| 5,660,036 | A | 8/1997 | Rozenwasser | |
| 5,682,736 | A | 11/1997 | Chia et al. | |
| 5,775,088 | A | 7/1998 | Grosz | |
| 5,797,258 | A | 8/1998 | Strobel et al. | |
| D398,551 | S | 9/1998 | Kupelian | |
| 5,911,677 | A | 6/1999 | Kupelian | |
| D424,964 | S | 5/2000 | Chia et al. | |
| 6,209,306 | B1 | 4/2001 | Chia et al. | 59/80 |

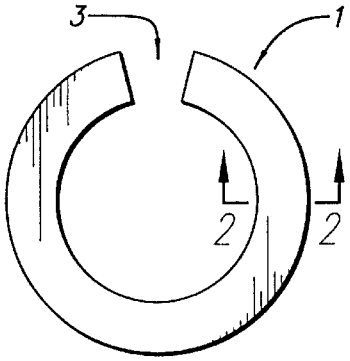
FIG. 1
PRIOR ART
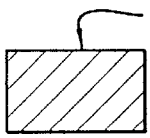
FIG. 2
PRIOR ART
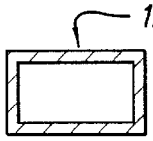
FIG. 2A
PRIOR ART
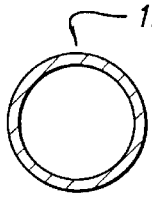
FIG. 2B
PRIOR ART
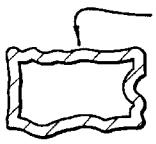
FIG. 2C
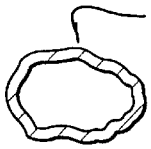
FIG. 2D
FIG. 3
PRIOR ART
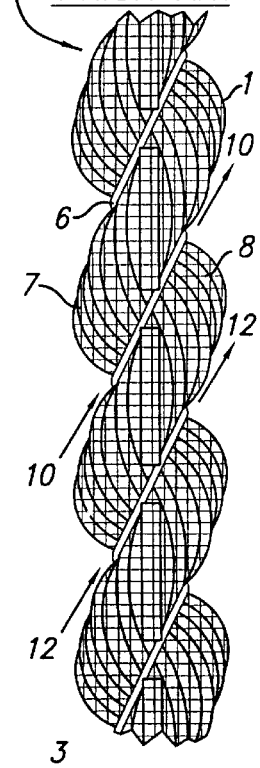
FIG. 4
PRIOR ART
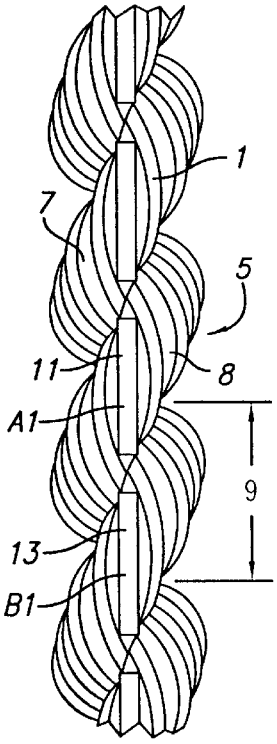
FIG. 5
PRIOR ART
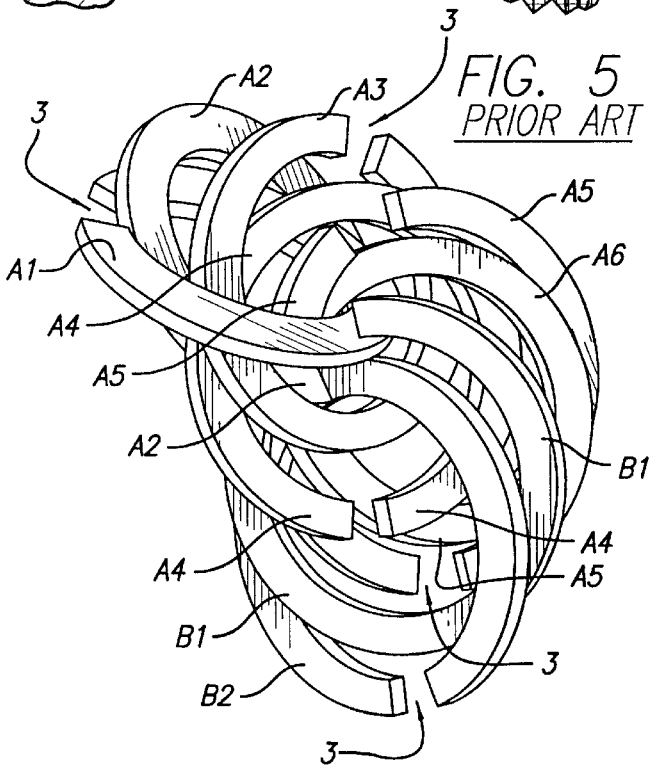

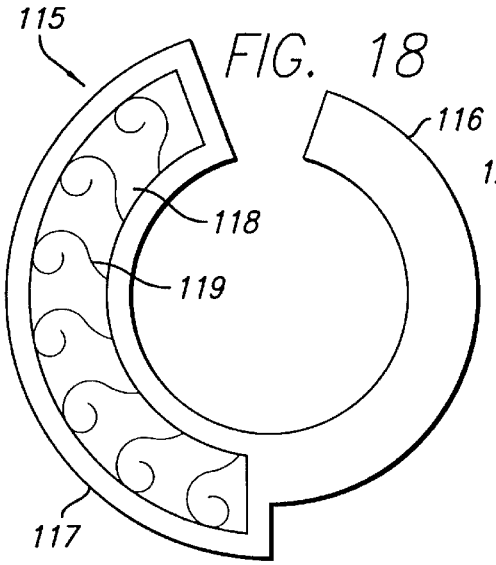
FIG. 18
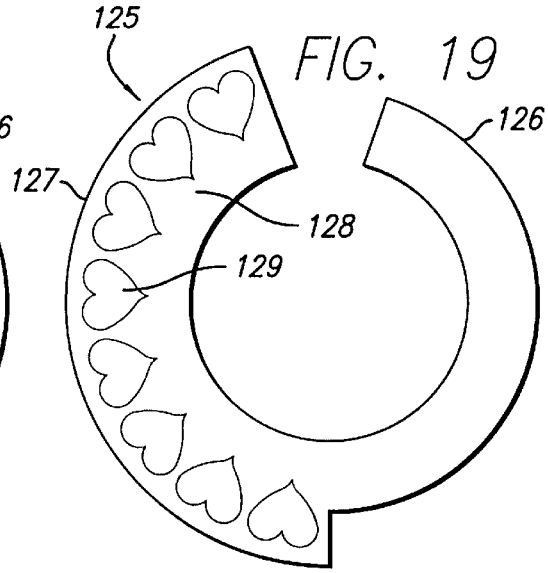
FIG. 19
FIG. 20
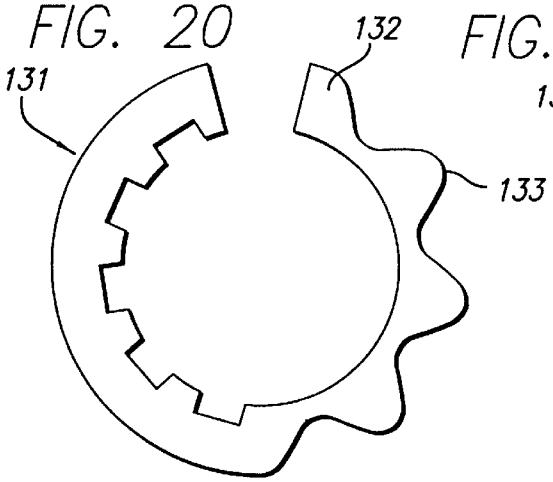
FIG. 22
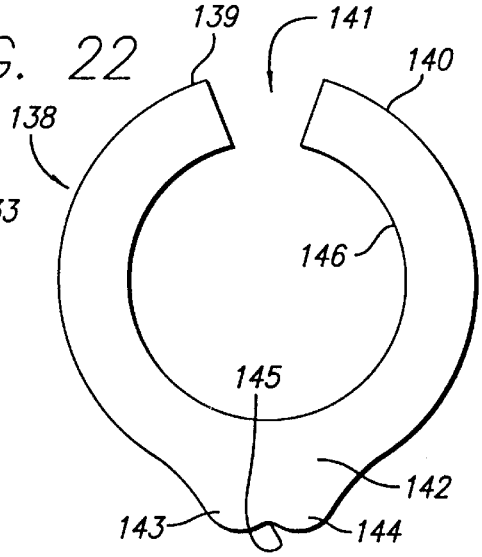
FIG. 21
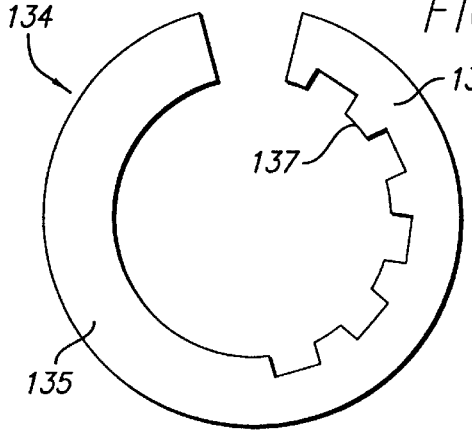
FIG. 23
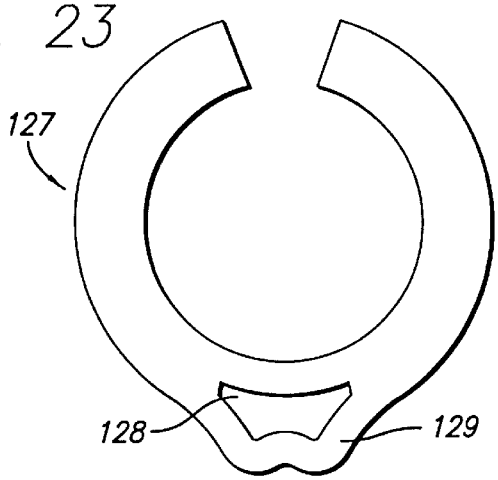

JEWELRY ROPE CHAIN LINK ELEMENT

CROSS-REFERENCE TO RELATED APPLICATION

This application is a continuation-in-part of application Ser. No. 09/287,972, filed Apr. 7, 1999 and entitled "DECORATIVE JEWELRY ROPE CHAIN", the entire contents of which are incorporated herein by reference.

REFERENCE TO DOCUMENT DISCLOSURE CERTIFICATES

Reference is made to Applicants' prior U.S. Document Disclosure Certificates: Ser. No. 449,115 recorded Dec. 22, 1998; and Ser. No. 455,009 recorded Apr. 19, 1999, both of which are incorporated herein by reference.

BACKGROUND OF THE INVENTION

1. Field of the Invention

This invention relates to the field of decorative jewelry items, and more particularly to the basic structural link element of a jewelry rope chain exhibiting unusual visual properties.

2. Brief Description of the Prior Art

Rope chains are a popular type of jewelry made from linking a number of regular annular links together in a repetitive manner and usually soldering or welding every two links together. The result is a chain that is flexible and pleasing to the eye. The annular links are often formed of gold or other precious metal and are circular in form with flat sides. The circle is not complete as there must be a gap to permit the linking of the links with each other.

Jewelry rope chain has been made for many years. Although rope chains can be made by machine, the better quality rope chains are usually manufactured by hand. While a rope chain has the feel and look of a rope, it is actually made up of a series of individual C-shaped flat link elements made from a precious metal such as silver or gold. The C-shaped link elements are gapped and fastened together in a particular way, such that tightly interlinking annular link elements give the appearance of intertwining helical rope strands. The link elements of hand-made rope chains are made with a tighter fit and are more visually appealing than are machine-made rope chains. A number of annular link elements are connected and intertwined together in a systematic and repetitive pattern of orientation, resulting in an eye-pleasing, flexible, and delicate-appearing chain that looks and feels like a finely braided helix.

In a conventional rope chain, the orientation pattern of individual link elements producing the rope chain is repeated every several link elements, for example every four link elements, and as such is referred to as a four-link rope chain. In an improvement to the conventional basic rope chain, it is taught in U.S. Pat. No. 4,651,517 that the link elements can be constructed in different and narrower dimensions so that the pattern is repeated every six link elements or even every eight link elements. In U.S. Pat. No. 5,301,498, to Chia et al., it is suggested that, by narrowing the cross-section of the link element, the six-link rope chain's connected segments appear finer than those of the four-link version and consequently provide a more delicate and refined presentation than that obtainable with a four-link rope chain arrangement. While the '517 patent uses a six-link rope chain as a preferred embodiment, that patent teaches the formulas for creating rope chains consisting of a repeated series of six, eight, or more link elements.

Some manufacturers of jewelry use different colored gold and silver elements to enhance the beauty of the jewelry article. Examples are: rope chains in which sets of link elements of one color alternate with sets of link elements of another color; and bracelets or necklaces constructed of interconnected twisted loops exhibiting alternating colors along their lengths. Gold, for example, is available in at least four colors; white, yellow, rose (pink), and green.

However, in all of the prior art construction techniques for producing rope chain jewelry, each link element is of a single solid color, texture, shape, and pattern, e.g., each link element may be stamped from a solid thin sheet of precious metal, such as gold. Thus, for example, while an all yellow gold rope chain or an all white gold rope chain is attractive, it is otherwise uninteresting due to the monotonic nature of its unvarying coloration and/or texture along the link elements of the chain. Those prior art rope chains that do exhibit variations of colors along their lengths nevertheless are constructed of individual link elements each of which is of a single solid color, texture, shape, and/or pattern.

Other jewelry articles exhibit variations of colors along their lengths using interconnected twisted chain loops, but they are not regarded as rope chains as defined herein.

Moreover, all prior art link elements are generally C-shaped with a constant, typically rectangular cross section. As a result, a predictable visual effect is realized when the C-shaped link elements are assembled to simulate an intertwined rope chain. Additionally, after all of the link elements have been assembled into a finished rope chain jewelry item, a large percentage of the total volume of precious metal in each link element is forever hidden from view. That is, for the structural integrity of the rope chain, certain dimensional parameters have to be maintained, and there have been few attempts in the prior art of manufacturing rope chains to reduce the amount of precious metals being used, for fear of lessening or destroying the structural integrity of the finished product.

One example of prior attempts to reduce the amount of precious metal in a rope chain link element can be found in U.S. Pat. No. 5,185,995 to Dal Monte. In this patent, it is taught to modify the conventional cross sectional shape of a link element by maintaining a large mass of material at the exterior edge periphery and forming a narrow or pointed interior edge periphery. However, since the cross section for a particular link element is constant throughout the extent of the link element, this severely limits the flexibility of design. For example, manufacturing a link element having different link thicknesses, or different link widths, or different link cross sectional patterns along the extent of the link is not suggested in the '995 patent, and may not be possible when employing the limited teaching of the '995 patent.

Furthermore, because of the thin pointed interior edge of a link manufactured to the specifications of the '995 patent, the interior edges are fragile and can easily be damaged due to the softness of the precious metal (e.g., gold) and due to the abuses that may be inflicted on the rope chain while in use (excessive bending or twisting). Such inadvertent, but normal, usage can compress the width of the links, resulting in a loose interfitting of the links.

Other prior art teaches forming flat surfaces on both sides of a link element to produce a double spiral effect within the already double spiral effect of an otherwise conventional rope chain. Both U.S. Pat. Nos. 5,425,228 and 5,285,625 show flattened sides on the link elements, the latter patent showing the effects of such flattened sides in FIG. 5 thereof. However, neither of these patents teach constructing a rope chain which has two visually different helixes.

SUMMARY OF THE INVENTION

The present invention provides the means and method for constructing rope chain link elements in a way to produce a rope chain piece of jewelry in which each link element, or selected link elements, and therefore the rope chain itself, exhibits a unique visual property, e.g., surface texture, coloration, surface reflectivity, pattern feature or characteristic, shape, or other physical appearance attributes. Such unique visual property traits for the succession of link elements results in a more attractive, fanciful, more delicate and interesting fashion jewelry item.

In addition to exhibiting unique visual properties, employing the concepts of the present invention can produce lengths of rope chains in which one of the apparent strands of "rope" has a different visual appearance than the intertwining "rope" strand. That is, the appearance of a rope strand at any point along the length of rope chain will be visually different than the adjacent strand. For example, one strand may have an apparent smaller diameter than that of the adjacent strand. Or, the texture, coloration, surface reflectivity, pattern, shape, or other physical attribute of one strand may be totally distinct relative to the adjacent strand.

Additionally, in the process of altering the physical shape of the individual link elements, simultaneously with the enhancement of the visual effect due to the shape altering techniques, small amounts of the precious metal making up the link elements are removed without reducing the effective dimensional characteristics of the elements and, therefore, without diminishing the structural integrity of the finished rope chain product. Moreover, although not intended to be limiting, most of the variations of the present invention maintain a rectangular cross section for all or portions of the link elements. Thus, a distinct and decorative rope chain of a given length may have the identical effective rope diameter as one made with a common C-shaped link of constant cross sectional area, and yet result in substantial manufacturing cost savings due to less material being used in the manufacture of each individual link element, and due to the ability to form the links using inexpensive stamping techniques.

It can therefore be appreciated that creating link elements having variably changing cross sections to provide uniquely shaped building blocks for producing exciting and beautiful visual effects in the construction of rope chains, may simultaneously have the synergistic effect of making such physically altered link elements, and thus the rope chains from which they are made, less expensive.

In accordance with one aspect of the invention, there is provided, in a length of jewelry rope chain of the type comprising a series of tightly interfitting gapped link elements and having the appearance of intertwining helical strands, gapped link elements each having a first major surface, an opposite second major surface, an interior edge, and an exterior edge, the improvement wherein: link width is defined as a distance, measured along either of the major surfaces, between a pair of parallel lines perpendicular to the major surfaces and tangent to, respectively, the interior and exterior edges; and at least some of the link elements in the length of rope chain have an irregular link width.

Preferably, at least some of the link elements in the length of rope chain have a non-symmetrical irregular link width along the extent of the link element.

In another aspect of the invention, each of the link elements that have an irregular link width is divided into segments, each segment possessing a unique link width character relative to an adjacent segment.

One variation of a gapped link element made in accordance with the invention has a smooth interior edge and an irregular, preferably patterned, exterior edge.

An alternative variation has a smooth exterior edge and an irregular, or patterned, interior edge.

In another aspect of the invention, both interior and exterior edges may be irregular or patterned, the exterior edge preferably patterned for an attractive visual effect and to reduce the amount of precious metal, and the interior edge irregular solely to reduce the amount of precious metal needed to form the link element.

In yet another aspect of the invention, rather than having the major, substantially planar, upper and lower surfaces of each link element uniformly smooth, one of the major surfaces, or both such major surfaces, may exhibit perceptively different physical shapes in accordance with a predetermined engraved, etched, diamond cut or other formed pattern arrangement on each major surface. The two major surfaces so configured may be identical on both upper and lower major surfaces, or they may be different one from the other. For example, small portions of each upper major surface may be cut away in a desired pattern, and other portions may be cut away in a second desired pattern. Similarly, small portions of each lower major surface may be cut away in a third desired pattern, and other portions may be cut away in a fourth desired pattern. The designs and arrangement of different patterns may be the same or different on the upper and lower major surfaces.

Instead of, or in addition to, differently shaped major surfaces, the two major surfaces may exhibit differently textured portions, e.g., one portion of a link element may be shiny while another portion may have a sandblasted, frosted, patterned, matte, or diamond cut finish appearance. Also, either major surface may be of a uniform shape and/or texture, while the other major surface is portioned as described.

A further variation has half of the link at a reduced annular width, which reduces material but nonetheless gives the appearance of a rope chain having an effective diameter the same as if the reduced half was of normal annular width.

Instead of reducing the annular width of one half of a gapped link, one half may be enlarged in annular width and provided with openings in the enlarged half. The net amount of precious metal is reduced, as desired, and yet the finished rope chain will have a large diameter and enhanced detail and beauty.

Thus, the interconnecting links may have differently colored, patterned, and/or textured portions, and may have different irregular or patterned shapes or shaped portions. For example, some or all of the link elements making up the rope chain may be partially or wholly smoothly circular with patterned major surfaces, circular with peripheral undulations, circular with peripheral gear-like teeth, circular with diamond cut gouges or notches, may have constantly varying cross sectional portions, may have multiple or relatively large openings therethrough from one major surface to the other, and/or may have an overall configuration that is star shaped, baguette shaped, square shaped, rectangular shaped, oval shaped, diamond shaped, heart shaped, etc. Similarly, different portions of each link element may have such different physical shapes.

A jewelry rope chain link element constructed in accordance with the invention preferably, but not necessarily, may have the shape and configuration of a standard annular link element with at least a portion removed and has a maximum link width equal to that of a similar standard annular link element without any portion removed.

Similarly, a length of rope chain employing link elements as described in the previous paragraph, has an effective maximum diameter equal to that of a similar length of rope chain constructed of solid, standard size annular link elements without any portion removed.

From the viewpoint of a finished length of rope chain, the invention provides an improvement over the prior art, wherein: each link element in the length of rope chain comprises a link portion exhibiting a first visual property, and another link portion exhibiting a second, different, visual property; whereby, when viewed from one side of the length of rope chain, the appearance of one of the helical rope strands is different than the appearance of the other, adjacent, helical rope strand along the length of rope chain.

For example, in one variation, the one helical rope strand is of a predetermined effective diameter, and the adjacent helical rope strand is of a different effective diameter than that of the one rope strand.

In another variation, the one helical rope strand has the shape of a helical cylindrical tube intertwined with the adjacent helical rope strand, and the adjacent helical rope strand has the shape of a helical cylindrical tube with an outer surface portion thereof cutaway along the length of the helical cylindrical tube.

For the latter variation, the outer surface cutaway portion of the adjacent helical rope strand may be formed by a diamond cut process operating on pre-assembled link elements.

As a result of the various combinations possible in the manufacture of jewelry rope chains in accordance with the present invention, a virtually limitless number of different design possibilities exist, and preferred ones of such possibilities are shown and described herein. It is to be understood, however, that all combinations of: the number of interconnected link elements in the repeated pattern along the rope chain; solid or portioned coloration and/or texturing; different designs of the portioned regions of each major surface of the link elements; and different physical shape and/or visual properties as identified in this description may be employed in the manufacture of jewelry rope chains and are contemplated variations of the preferred embodiments specifically shown and described.

BRIEF DESCRIPTION OF THE DRAWING

Further objects and advantages and a better understanding of the present invention may be had by reference to the following detailed description taken in conjunction with the accompanying drawings in which FIGS. 6, 18, 17, 34, 35, 36, and 37 are lined for color, and in which:

FIG. 1 is a plan view of an annular link element which is the basic building element for the construction of jewelry rope chains as known in the prior art;

FIG. 2 is a cross sectional view taken along the line 2—2 in FIG. 1, also known in the prior art;

FIG. 2A is a view similar to that of FIG. 2, except that the link element is rectangular and hollow in cross section, known in the prior art;

FIG. 2B is a view similar to that of FIG. 2A, except that the link element is circular and hollow cross section;

FIG. 2C is a view similar to that of FIG. 2A, except that the generally rectangular cross sectioned link element does not have straight sides, but rather sides of an indeterminate shape;

FIG. 2D is a view similar to that of FIG. 2B, except that the generally circular cross sectioned link element does not have smooth sides, but rather sides of an indeterminate shape;

FIG. 3 is a side elevational view showing a section of a prior art rope chain during the manufacturing process, before removing a forming wire used to maintain proper orientation of the series of link elements;

FIG. 4 is a front elevational view of the outward appearance of a jewelry rope chain of the prior art showing a uniform visual appearance for all link elements in the chain for the entire length thereof;

FIG. 5 is a perspective view of a number of loosely interconnected link elements in an expanded view to show the method of interlinking to form sets of link elements in the series of link elements along the rope chain, as is known in the prior art;

FIGS. 6–45 show plan views of link elements each of which are uniquely different in shape, texture, color, or configuration than other link elements in the accompanying figures, illustrating a variety of possibilities for the design and structure of the link elements which are assembled to form a rope chain, FIG. 6 depicting a link element in which one half is of one color and of one shape, and the other half is of another color and of another shape;

FIG. 7 is a plan view of a link element having a smooth interior edge and a full undulated exterior edge 22;

FIG. 8 is a plan view of a link element having a crenelated interior edge and an undulated exterior edge 28;

FIG. 9 is a plan view of a link element having a smooth exterior edge and a crenelated interior edge;

FIG. 10 is a plan view of a link element having smooth exterior and interior edges, and a patterned area along a central major surface;

FIG. 11 is a plan view of a link element having smooth exterior and interior edges with a patterned area along a major surface thereof;

FIG. 12 is a plan view of a link element having smooth exterior and interior edges, and with a textured patterned groove along a central major surface;.

FIG. 13 is a plan view of a link element having smooth exterior and interior edges with textured depressions in a major surface thereof adjacent the exterior and interior edges;

FIG. 14 is a plan view of a segmented link element, one half having a narrow annular width and the other half gradually increasing to a wider width at its middle;

FIG. 15 is a plan view of a segmented link element, one half having a narrower than normal annular width, and the other half having a non-linear relatively wider annular width;

FIG. 16 is a plan view of a segmented link element, one half having a narrow annular width, and the other half having a relatively wider annular width with an opening therein;

FIG. 17 is a plan view of a segmented link element, one half having a narrow annular width, and the other half having a relatively wider annular width with an opening therein and a portion with a different material or differently colored material;

FIG. 18 is a plan view of a segmented link element, one half having a narrower annular width, and the other half having a relatively wider annular width largely open with tendril-like filigree filaments bridging across the opening;

FIG. 19 is a plan view of a segmented link element, one half having a narrower annular width, and the other half having a relatively wider annular width with a repeating symbol therein or thereon;

FIG. 20 is a plan view of a link element similar to that shown in FIG. 9, but with one half having an undulated exterior edge and no interior crenels;

FIG. 21 is a plan view of a link element similar to that shown in FIG. 9 with only one side having a crenelated interior edge, and with the other half having smooth interior and exterior edges;

FIG. 22 is a plan view of a link element similar to that shown in FIG. 1, but with a double bumped projection on the exterior edge thereof;

FIG. 23 is a plan view of a link element similar to that shown in FIG. 22, but with an opening in the projection;

FIG. 24 shows a baguette shaped link element configuration version of the link element of FIG. 11;

FIG. 25 shows a square shaped link element configuration;

FIG. 26 shows an oval shaped link element configuration version of the link element of FIG. 10;

FIG. 27 shows a diamond shaped link element configuration;

FIG. 28 shows a link element in which an arcuate concave cut is made in each side;

FIG. 29 shows a link element having a smooth interior edge and a crenelated exterior edge;

FIG. 30 shows a link element similar to that of FIG. 28, but with flat, rather than concave, side cutouts;

FIG. 31 shows a link element having smooth exterior and interior edges, the annular width of which is less than standard;

FIGS. 32 and 33 are plan and side elevational views, respectively, of a link element which has notches or depressions spaced around the periphery;

FIG. 34 shows a link element having a side of a first material and an opening therein, and a side of narrow annular width with undulations and of a second material;

FIG. 35 shows a link element of having a first side made of a first material with openings therein separated by a solid annular segment of a second material, and a second side of a third material and of a narrowed annular width;

FIG. 36 shows a link element having a side of a first material and with a plurality of spaced differently shaped openings, the other side made of a second material and having a narrower-than-standard annular width;

FIG. 37 shows a link element having a side of a first material and with a flattened edge, the other side made of a second material and having a standard annular width;

FIG. 38 is a partial side elevational view of a link element in which one or both of the textured major surfaces are serrated, or knurled;

FIG. 39 is a partial side elevational view of a link element in which one or both of the textured major surfaces have connected angled plate-like segments producing a saw-toothed profile;

FIG. 40 is a partial side elevational view of a link element in which one or both of the textured major surfaces have V-shaped grooves;

FIG. 41 is a partial side elevational view of a link element in which the exterior edge is serrated, scored, or knurled, and the major surfaces are planar;

FIG. 42 is a partial side elevational view of a link element in which both major surfaces and the exterior edge are serrated, or knurled;

FIG. 43 is a plan view of a link element having smooth exterior and interior edges, and with a serrated, scored, or knurled, major surface;

FIG. 44 is a plan view of a link element having a smooth interior edge, a serrated, scored, or knurled, exterior edge, and a serrated, scored, or knurled, major surface;

FIG. 45 is a partial plan view of a link element having portions of its major surface smooth and portions serrated, scored, or knurled;

DETAILED DESCRIPTION OF THE PREFERRED EMBODIMENTS

Figure 6:
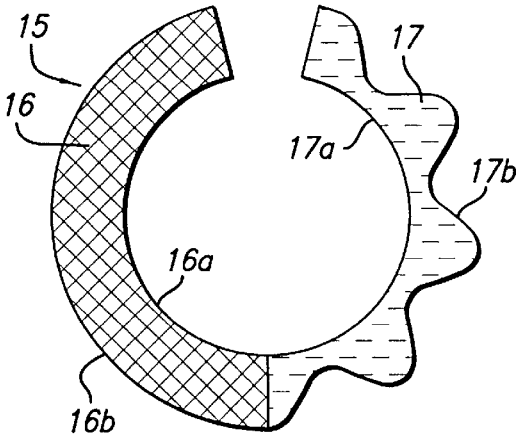

FIG. 1 is a plan view of an annular link element used in the construction of jewelry rope chains as known in the prior art. In general, FIGS. 1–5 depict: a conventional rope chain arrangement (FIGS. 3 and 4); a typical annular link element (FIGS. 1 and 2) employed as a basic building element in the construction of the rope chain; and a number of loosely interconnected annular link elements (FIG. 5) to illustrate the positional relationship of adjacent annular link elements along the rope chain.

For the purposes of this description, the following definitions are provided.

"Rope chain" is a series of sets of interlinked, or interconnected, link elements which has the appearance of a plurality of braided, or helically intertwined, multi-fiber strands of hemp, flax, or the like.

"Standard" or "Ordinary" refers to the dimensional characteristics of annular link elements without major surface or edge variation and whose dimensions follow the recommendations according to the aforementioned U.S. Pat. No. 4,651,517, for example, i.e. whose dimensions result in a tightly fitting series of link elements having the appearance of intertwining helical strands of rope.

A "set" is the number of adjacent interlinked, or interconnected, link elements making up a structurally repeated pattern along the chain. In the accompanying drawings and associated text, a six-link set is used for purposes of ease of visual presentation and description. The preferred number of link elements in a set is eight.

A "group" is a number of adjacent interlinked, or interconnected, link elements exhibiting identical visual properties. The number of link elements in a group may be the same or different than the number of link elements in a set. Groups may be uniformly or randomly distributed along the rope chain.

A "link" is the basic building element (also referred herein as a "link element"), a number of which are assembled in series to form a rope chain. Link elements of the prior art are annular in shape with an open gap having a length slightly greater than the width of the annular link. In accordance with the present invention, a link element may have a circular, baguette, oval, diamond, rectangular, square, heart, or other geometrical shape. Each is provided with a gap at a selected position along the perimeter thereof thereby maintaining a generally C-shaped overall configuration. In such a generally C-shaped overall configuration, the inner periphery will be referred to herein as an interior edge, and the outer periphery will be referred to as an exterior edge. While the link elements of a rope chain are not necessarily annular, it is the preferred configuration for the basic building element of a rope chain, and for that reason an annular link element will be used in most of the examples shown and described herein.

A "channel" is the path which the eye follows in passing along the rope chain at the apex of the V-shaped helical groove formed between the apparent intertwined rope braids. Hence, in the preferred embodiments described herein, the rope chain has the appearance of a pair of intertwined braids of ropes, and thus there exists two such helical channels offset from one another by one-half of the pitch of either helix.

A "visual property", as used herein, is a characteristic of an object which presents a particular visual image to the eye. Such characteristics include, but are not limited to, color, texture, pattern, reflectivity, design, or shape. Although shape is also a physical property of an object, in the art of jewelry making, it is often the physical shapes which impart beauty and delicateness to a fashion item.

"Color", as used herein, refers to the quality of the link element or portion thereof with respect to light reflected by it and visually perceived by the eye as a particular hue, saturation, and brightness of the reflected light. In most cases, the different colors exhibited by a link element or portion(s) thereof result from the use of different materials (white gold as differing from yellow gold as differing from rhodium as differing from enamel coatings of different hues, etc.

The "major surface" of a link element refers to the substantially flat or planar upper and lower facial surfaces of the link element. Such surface, although being substantially planar, nevertheless may have raised or depressed patterns therein, or may be notched, gouged, textured, or otherwise physically altered to present a desired pleasing visual effect to the observer. Additionally, the upper and lower facial surfaces need not be flat. For example, the link elements may be tubular, or otherwise circular in cross section, and yet have the uppermost and lowermost surface portions lying in respective parallel planes.

The "interior" and "exterior" edges of a link element are, respectively, the inner and outer peripheral sides which span between the upper and lower major surfaces of a link element.

"Link width" is defined as a distance, measured along either of the major surfaces, between a pair of parallel lines perpendicular to the major surfaces and tangent to, respectively, the interior and exterior edges.

"Link thickness" is defined as a distance between and perpendicular to the planes of the upper and lower major surfaces.

Referring now to FIGS. 1 and 2, an annular link element 1 is shown to have a generally rectangular cross section (FIG. 2) and a gap 3 having sloping edges, the narrowest width of gap 3 being slightly larger than the thickness of the annular link element 1.

While conventional rope chains are constructed using annular links having a solid rectangular cross section as shown in FIG. 2, variations with different cross sectional geometries are possible. FIGS. 2A and 2B depict two such variations. The cross section of tubular link 1A in FIG. 2A is rectangular and hollow (known from U.S. Pat. No. 4,651,517). Another variation is shown in FIG. 2B in which the tubular link element 1B has a hollow circular cross section (known from U.S. Pat. No. 5,537,812).

FIG. 2C is a view similar to that of FIG. 2A, except that the generally rectangular cross sectioned link element 1C does not have straight sides, but rather sides of an indeterminate shape.

FIG. 2D is a view similar to that of FIG. 2B, except that the generally circular cross sectioned link element 1D does not have smooth sides, but rather sides of an indeterminate shape. This figure, and FIG. 2C are presented for representing that the two major surfaces and the interior and exterior edges of a link element can take on any surface shape or texture, not just those illustrated in the other FIGS. 6–45.

All of the link element embodiments and variations of the present invention illustrated in FIGS. 6–45 can be solid or hollow in cross section, and may have any geometrical cross sectional configuration. A non-limiting solid rectangular cross section is chosen as exemplary in the accompanying drawings for illustrative purposes only.

Conventional rope chains, such as those shown in FIGS. 3 and 4, are made with a systematic and repetitive interlinking of basic annular link elements 1. The annular link element 1 must meet certain dimensional requirements for the interlinking to result in a well-fitting rope chain. Such dimensions are known in the art and will vary from a four-link variety to a six-link variety to an eight-link variety, and so on. Determining the proper dimensions for the annular link element 1 and the gap 3 therein, depending upon the number of desired link elements to form a set of interlinked link elements, can be readily understood by reference to the aforementioned U.S. patents, especially U.S. Pat. No. 4,651,517. As can be viewed in FIGS. 3 and 4 herein, the intertwined link elements 1 of a segment of a conventional rope chain 5 are shown in FIGS. 3 and 4 in the form of a six-link variety. In their assembled form, the series of link elements 1 produce the appearance of a first braid of rope 7 and a second braid of rope 8, the combination of which results in a double intertwined helical appearance.

As best seen in FIGS. 3 and 4, the apparent intertwining of a pair of rope strands or braids 7 and 8 results in a V-shaped groove between the braids at any position along the rope chain. The path along the apex of such V-shaped groove is referred to herein as a "channel", and since there are two apparent rope braids 7 and 8, there are, likewise, two defined channels indicating FIG. 3 by the directional arrows 10 and 12. Channel 10, along the length of the rope chain, defines a helix, as does channel 12. However, the two channels never intersect one another, and are parallel to one another along the length of the rope chain separated axially by one half of the pitch of either of the two channels. In the prior art of FIGS. 3 and 4, there is no visual difference between following along the two helical channels 10 and 12, since the rope chain is comprised of a repetitive series of sets of link elements 1, and all link elements have the same visual property (they are all of the same color, texture, and shape for example).

FIG. 3 is a side elevational view showing a section of a prior art rope chain during the manufacturing process, before removing a forming wire used to maintain proper orientation of the series of link elements.

Further with respect to FIG. 3, in the construction of a rope chain using annular link elements 1, it is necessary to maintain a tightly interlinking of the annular link elements until the entire rope chain is completed, and for that purpose, a pair of support wires 6 are positioned in the channels 10 and 12 and are kept in place until such time as a means of fixing the assembled link elements 1 together is completed. In U.S. Pat. No. 4,651,517, for example, after building up the link elements in the manner described therein, to form the double helix chain, the link elements are held in the desired juxtaposition temporarily by a thin metal wire wrapped around the link elements. Then, solder is intermittently applied to every pair of adjacent link elements at the external periphery thereof. The wire is then removed and does not comprise a part of the completed rope chain.

FIG. 4 is a front elevational view of the outward appearance of a jewelry rope chain of the prior art showing a uniform visual appearance for all link elements in the chain for the entire length thereof.

In FIG. 4, the distance denoted by numeral 9 encompasses the link elements of a "set" of link elements, and it will be noted that link elements 11 and 13 lie in the same plane, but are angularly displaced from one another along the link elements of the rope chain by 180°. That is, following the position of link element 11 counterclockwise (as seen from the top) and downwardly, it will be observed that each subsequent link element is angularly spaced at a constant 30° angle, and since there are six link elements per set, a 180° turn of link element 11 downwardly along the rope chain will be effectively rotated 180° to assume the position of link element 13. As is clearly visible in FIG. 4, a series of sets of link elements 1 makes up the length of rope chain illustrated.

For an eight-link "set" (not shown, but defining a preferred embodiment), each subsequent link element will be angularly spaced at a constant 30° angle.

FIG. 5 is a perspective view of a set of loosely interconnected link elements in an expanded view to show the interlinking of the link elements to form a set of link elements in the series of link elements along the rope chain, as is known in the prior art. The drawing of FIG. 5 is copied from U.S. Pat. No. 4,651,517 (FIG. 8*g* thereof), and shows a number of annular link elements A1–A6, B1 and B2, each with a gap 3 permitting the complex interlinking arrangement shown. A set of annular link elements A1–A6, when tightly assembled, results in the structured, repeated, pattern shown in FIG. 4 with the annular link element A1 of a first set of link elements lying in the same plane as the first annular link element B1 belonging to the next adjacent set of annular link elements B1–B6 (only link elements B1 and B2 shown).

The remaining figures to be described, FIGS. 6–45, illustrate examples of a virtually limitless number of variations of the design and construction features of link elements that may be assembled into a distinctively beautiful and unique rope chain having appealing visual properties.

It will be appreciated that a link element may exhibit multiple colors due to a variety of possible physical constructions. For example, as in the aforementioned prior application Ser. No. 09/287,972, entitled "DECORATIVE JEWELRY ROPE CHAIN", a link element may be of laminated construction, such that one major surface is of one material or color and the opposite major surface is of a different material or color. Additionally, or alternatively, each or both major surfaces may be divided into portions, each portion exhibiting a color different from its adjacent portion.

In FIG. 6, for example, the plan view of the annular link element 15 has, on one planar major facial surface thereof, a first portion 16 of a first color and a second portion 17 of a different color. The link element 15 may be formed, for example, by stamping a flat sheet constructed of two edge-joined layers of different flat materials, or of two edge-joined layers of materials of different colors and/or textures and/or coatings (such as by the application of an enamel).

In this connection, most of the remaining figures, FIGS. 7–45 are not lined for color. However, it will be understood that all, or portions, of each of the link elements to be described hereinafter may be of a color selected from a variety of different colors, and/or may be made of a material selected from a variety of different materials. For example, any of the link elements described herein may have the entire surface, or portions thereof, of yellow gold, white gold, rose (pink) gold, green gold, silver, nickel, or rhodium, either solid, plated, or laminated; or such surfaces, or portions thereof, may be enameled.

In some cases, the gapped link elements may be stamped from a multicolored flat sheet, striped with a number of alternately colored gold materials, or alternately striped with different materials such as gold and silver. Such a striped flat sheet may be stamped to form gapped link elements in different orientations relative to the stripe pattern and relative to the gap position, resulting in a variety of interesting colored patterns in the finished rope chain, yet all such link elements can be stamped from the same striped sheet.

As previously mentioned, a major object of the invention is to reduce the amount of material making up the individual link elements to reduce manufacturing costs, while not detracting from the beauty and effective size (diameter) of the finished rope chain. Reducing material can be accomplished in many ways: by removing material from or forming edge depressions in the entire or portions of the exterior edge; by removing material from or forming edge depressions in the entire or portions of the interior edge; by removing material from or forming surface depressions in one or both major link surfaces; by forming openings in or through the major link surfaces; or otherwise narrowing the width of the entire or portions of the link elements. In some embodiments of the invention, part or all of a link element may have a link width larger than standard but with openings provided therein to result in a net reduction of material making up the link element.

The specific example shown in FIG. 6 depicts a link element 15 in which one half 16 of the link element is of one color and of one shape, and the other half 17 is of another color and of another shape. In the first half 16, the interior and exterior edges 16*a*, 16*b* are smooth, while for the second half 17, the interior edge 17*a* is smooth, and the exterior edge 17*b* has a repeated pattern of undulations or ripples. In this sense, the two link element portions, halves 16 and 17, exhibit different visual properties, as to both color and shape.

The link element shown in FIG. 6, and those shown in many others of the accompanying figures, has the shape and configuration of a solid standard size annular link element with portions removed (from undulated half 17), and with other portions intact and undisturbed from a standard shape and configuration (as with standard size half 16).

A rope chain constructed from a series of link elements 15 as shown in FIG. 6 is visually more attractive than one made from standard link elements which have no varying link width characteristics. That is, when a series of link elements 15 are assembled into a length of rope chain having the appearance of two intertwining helical strands, the appearance (visual properties) of one of the strands is different than the appearance (visual properties) of the other, adjacent, strand along the length of rope chain, when viewed from one side of the length of rope chain. Prior art rope chains constructed of standard link elements exhibit the same visual properties for all strands along the chain, as viewed from any direction. This is true even when the cross section of prior art link elements is not standard, for example according to U.S. Pat. No. 5,185,995 to Dal Monte.

Figure 7:
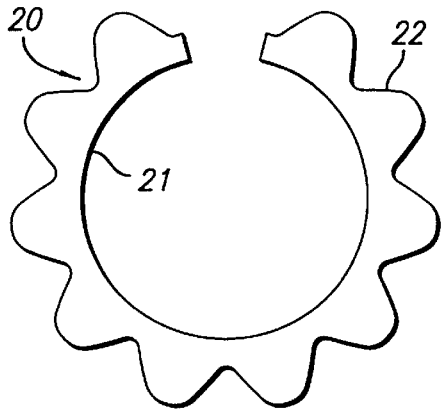

In accordance with a major feature of the present invention, the inner and/or outer periphery (i.e. the interior and exterior edges) of a link element is varied in shape, so that the resulting rope chain can attain distinctive and decorative configurations and/or result in substantially lower manufacturing costs. In FIG. 7, for example, the outer periphery 22 of the link element 20 is undulated, and the resulting rope chain will have a decorative design as a result of this shaping. In particular, FIG. 7 is a plan view of a link element 20 having a smooth interior edge 21 and a full undulated exterior edge 22. In addition to producing a unique and visually beautiful rope chain, the link variations shown in FIGS. 6 and 7 use less precious metal than an ordinary annular link configuration such as that shown in FIG. 1, since, preferably, the maximum link width of link element 20 is equal to standard link element width.

Figure 8:
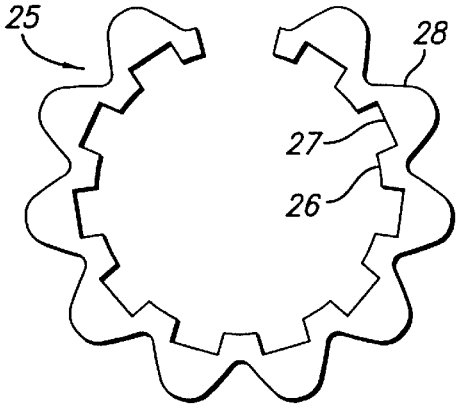

FIG. 8 is a plan view of a link element 25 having a crenelated interior edge 26 and an undulated exterior edge 28, i.e., link element 25 has the shape and configuration of a solid standard size annular link element with portions removed from both the interior edge 26 and the exterior edge 28. Preferably, the effective link width, as measured from the innermost side of the interior edge 26 to the outermost side of the exterior edge 28, is equal to standard link width. As compared to the link variation shown in FIG. 7, the crenels 27 have the desired effect of removing additional precious metal regions from the interior of the link to further reduce cost, without having any deleterious structural or visual effects in the finished rope chain product. From FIGS. 3 and 4, it will be appreciated that no part of the interior edges of the individual link elements are visible. Only an outer annular portion of each link element is visible, so that notches or crenels 27 may have a radial depth approximately equal to one half the width of the annular link. The allowed radial depth of the notches or crenels 27 is a function of the dimensions and configuration of each link element, and can be readily and easily determined by a person of ordinary skill in the art of rope chain manufacture.

Figure 9:
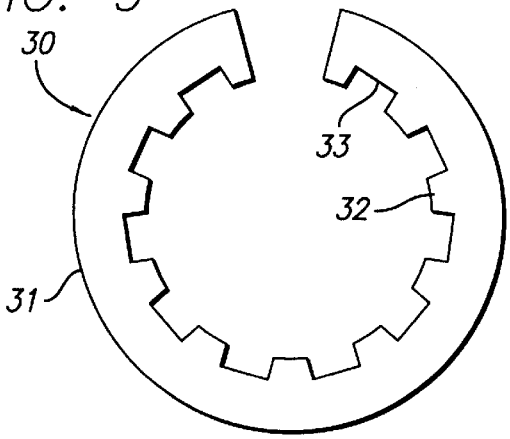

FIG. 9 is a plan view of a link element 30 having a smooth exterior edge 31 and a crenelated interior edge 32 defined by spaced crenels 33. The look and feel of a rope chain made with link elements 30 is identical to a conventional one made without interior crenelations. However, the weight and cost of such a rope chain will be less.

Link thickness, as used herein, is defined as a distance between and perpendicular to the plane of the first and second major surfaces, and at least some of the link elements in a rope chain may have an irregular link thickness along the extent of the link element.

FIGS. 10–13, 24, 26, 32, 33, and 38–45 show link elements that possess irregular link thicknesses along the extent of the link elements and bear surface ornamentation on each link element that will cause a rope chain to have a more decorative design than the conventional rope chain and yet use less precious metal than a standard link element without such irregular link thickness.

Figure 10:
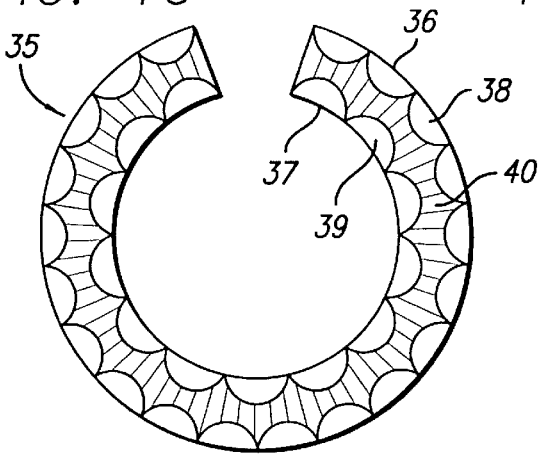

FIG. 10, for example, is a plan view of a link element 35 having smooth exterior and interior edges 36, 37, but with a groove, or raised center region, 40 along a central major surface of the link element. Link element 35, like the link elements of FIGS. 11–13, 24, 26, 32, 38–40, and 42–45, have the shape and configuration of a solid standard annular link element having portions of one or both major surfaces removed. For the variation in which the numeral 40 represents a raised center portion, the border surfaces 38,39 are smooth and planar, while the raised center region 40 may be serrated, textured, patterned, or diamond cut, as desired by the designer. For the variation in which the numeral 40 represents a groove, the groove 40 may be formed during the stamping procedure, or it may be formed after stamping by a diamond cutting step or other procedure which removes a desired amount of precious metal according to a desired pattern, leaving planar border surfaces 38,39. Border surfaces 38,39 may be polished to create a glitter effect and to emphasize the groove design pattern for either variation.

Figure 11:
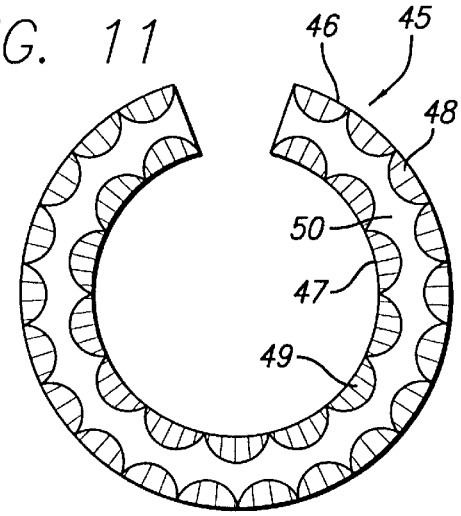

FIG. 11 is a plan view of a link element 45 having smooth exterior and interior edges 46, 47 with diamond cut or stamped depressions, or raised regions, 48,49 formed in a major surface thereof adjacent the exterior and interior peripheral edges 46, 47, leaving the central region 50 of a major surface of the link element 45 planar. Like the FIG. 10 embodiment, the non-planar border regions 48, 49 may be raised relative to the planar center region 50 and formed in a similar manner as the FIG. 10 embodiment.

Figure 12:
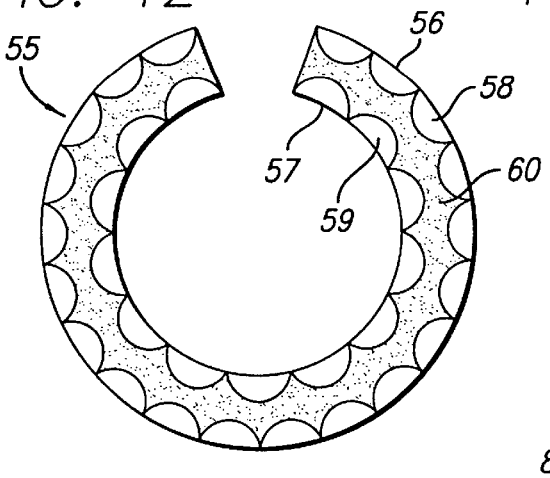

FIG. 12 is a plan view of a link element 55 having smooth exterior and interior edges 56, 57, but with a textured patterned groove, or raised region, 60 along a central major surface of the link element 55, leaving planar border surfaces 56, 57. The textured groove, or raised region, 60 may be formed during the stamping procedure or formed after stamping by an EDM or other mechanical or chemical material remover process.

Figure 13:
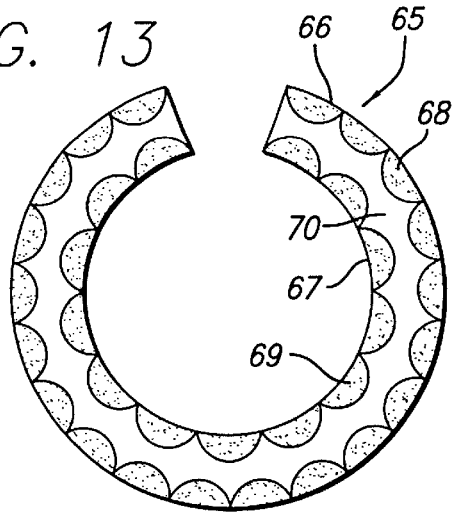

FIG. 13 is a plan view of a link element 65 having smooth exterior and interior edges 66, 67 with textured depressions, or raised regions, 68, 69 formed in a major surface thereof adjacent the exterior and interior edges 66, 67 leaving the central portion 70 of a major surface of the link element 65 planar. Like the FIG. 12 embodiment, the non-planar border regions 68, 69 may be raised relative to the planar center region 70 and formed in a similar manner as the FIG. 12 embodiment.

Figure 14:
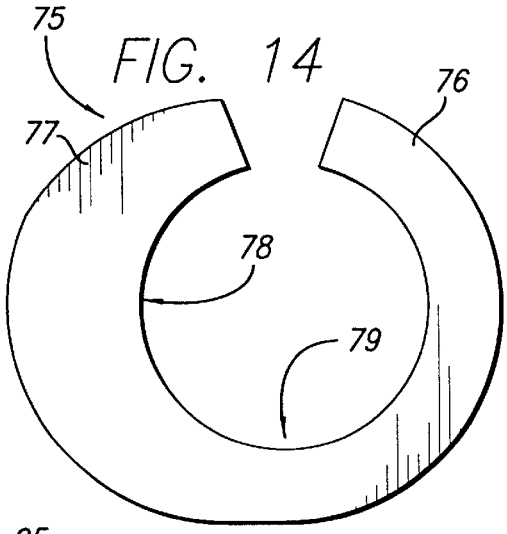

FIG. 14 is a plan view of a link element 75 that is segmented into two parts. For ease of presentation and illustration herein the terms "half" and "halves" will be used to mean "part" or "parts", a "part not necessarily being a "half". In link element 75, one half 76 has a narrower annular width, and the other half 77 gradually increasing to a wider annular width at its middle 78. The narrow half 76 is narrower than standard link elements to reduce the amount of material used, while the wider half 77 may be, at its middle 78, of standard width or greater than standard width. If the maximum width of the wider half 77 is standard, since the finished rope chain is "twisted," the effective diameter of the chain is the same as if all links were of standard width, but with the appearance of a large diameter rope strand braided with a small diameter rope strand.

In this connection, in the variations of link elements where one half is larger than the other half, such as those shown in FIGS. 14–19, and 35–37, a rope chain made from such link elements will have the appearance of a larger diameter rope strand braided with a smaller diameter rope strand.

Again, reducing the amount of precious metal in the manufacture of such gapped links, as in FIG. 14, reduces cost while actually enhancing the aesthetic character of the finished rope chain.

On the other hand, the maximum width of wider width half 77 may be larger than standard, whereby a rope chain made of link elements 75 will have an effective diameter larger than standard, and yet the net amount of precious metal will be the same as a smaller diameter chain due to the offset in weight attributed to the less than standard width half 76.

If size and appearance is more important than cost, rather than having the net amount of gold less than standard for the link element 75 shown in FIG. 14, the right side 76 may be of standard link width, making the left side 75 of a larger than standard size. Again, the general overall, effective, diameter of the finished rope chain will be the same as if all link elements were of a constant link width equal to the maximum link width of the left side 77.

It will thus be understood that, for all of the link elements described herein in which segments of a link element have different link widths, either the relatively smaller or relatively larger, segment may be of standard size.

Figure 15:
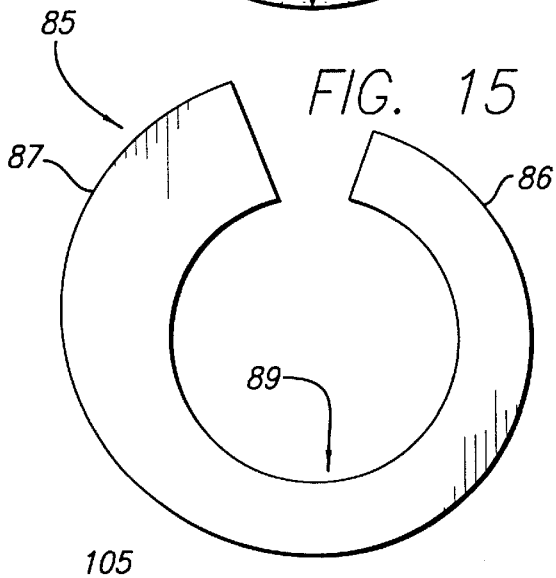

FIG. 15 is a plan view of a link element 85 that is segmented into two halves, one half 86 having a narrower than normal annular width, and the other half 87 having a relatively wider annular width, the width of the wider segment 87 being non-linear so as to narrow down to the width of the narrow half segment 86 at their junction 89. Comparing FIGS. 14 and 15, in a finished length of rope chain, the link 75 has the features of producing a more delicate appearance due to the relatively narrower helix it will form, and reducing more precious metal than that of FIG. 15. On the other hand, a length of rope chain made from the link 85 will have more body due to the relatively wider helix it will form.

Figure 16:
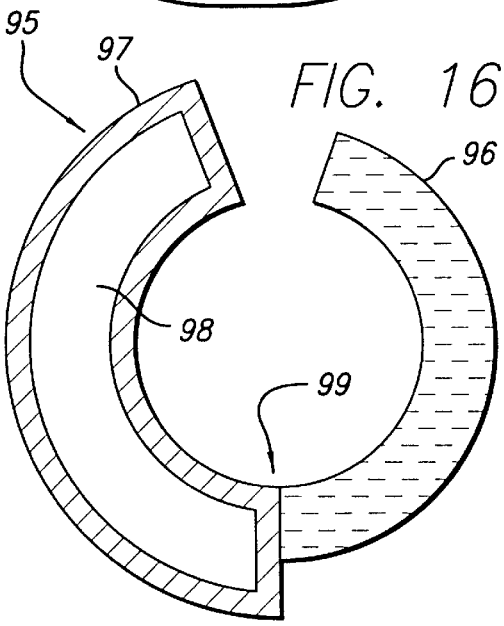

FIG. 16 is a plan view of a link element 95 that is segmented into two halves, one half 96 having a narrower annular width, and the other half 97 having a relatively wider annular width, the wider segment 97 having a stamped or formed opening 98 therein to define a framed wider segment portion transitioning with the narrower width portion 96 at junction 99. This figure illustrates the possibility of combining different shapes and different materials, since the open wider half 97 is lined for one color, while the solid narrower half 96 is lined for another color.

Figure 17:
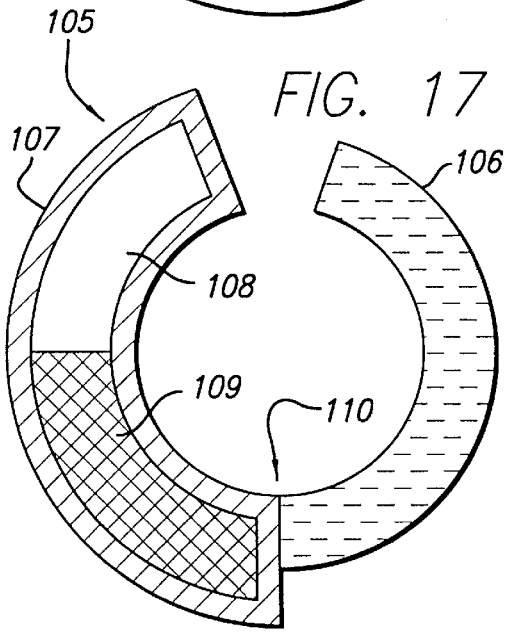

FIG. 17 is a plan view of a link element 105 that is segmented into two halves, one half 106 having a narrow annular width, and the other half 107 having a relatively wider annular width joining the narrower half 106 at junction 110. One half or any portion of the wider segment 107 has an opening 108 stamped or formed therein, and the other, closed, portion 109 is formed or filled with a different material or differently colored material.

FIG. 18 is a plan view of a link element 115 that is segmented into two halves, one half 116 having a narrower annular width, and the other half 117 having a relatively wider annular width. Preferably, the wider half 117 is largely open with tendril-like filigree filaments 119 bridging across the opening 118. Filaments 119 may be formed during the stamping process or attached after stamping. Alternatively, the wider half 117 may be solid with an embossed or engraved design, such as that shown, formed on the major surface thereof. If the wider half 117 is stamped, the filaments 119 will have a significantly thicker appearance than that shown.

FIG. 19 is a plan view of a link element 125 that is segmented into two halves, one half 126 having a narrower annular width, and the other half 127 having a relatively wider annular width, a repeating symbol 129 being punched, stamped, or otherwise formed, or embossed, or engraved in the major surface 128 of the wider segment 127.

FIG. 20 is a plan view of a link element 131 similar to that shown in FIG. 9, but with one half 132 of the link element 131 having an undulated exterior edge 133 and no interior crenels.

FIG. 21 is a plan view of a link element 134 similar to that shown in FIG. 9 with only one side 136 having a crenelated interior edge 137, and with the other half 135 having smooth interior and exterior edges.

FIG. 22 is a plan view of a link element 138 similar to that shown in FIG. 1, but with a double bumped protruding projection 142 on the exterior edge thereof opposite the position of the gap 141 in the link 138 between the two halves 139, 140. The two projecting bumps 143, 144 define a depression 145. The link width of the arms of the two halves 139, 140 is preferably narrower than standard. If the entire annular link element 138 had a less-than-standard width, the finished rope chain would be very loosely interconnected and unattractive. The purpose of the double bumped projection 142 is to simulate, during the assembly process, a link element of appropriate, i.e. standard, annular width at depression 145. Since the looseness or tightness of the finished rope chain product is dependent, among other factors, upon the width of the link at the location opposite the gap, employing the reduced material design for the link element 138 as shown will result in a perfectly formed rope chain with tightly interconnected links having the same flexibility as if the links were each made with a standard annular width in its entirety. This arrangement thus reduces material by a reduced annular width and by using fewer link elements per unit length of rope chain, making the chain to appear longer than the standard rope chain.

The purpose for the two spaced bumps 143, 144 is to affect the appearance of the channels between rope strands of a finished rope chain. Due to the spaced bumps 143, 144, the rope chain will display more precious metal (e.g., gold) in the channels between strands of the finished rope chain. As to construction concerns, the interior edge of a like adjacent link element 138 will fit perfectly within the depression 145, and the rope chain will have high structural integrity due to the width of the link element 138 between the interior edge 146 and the depression 145 being of standard dimension.

If desired, the arms 139,140 of link element 138 may be of standard width, and the rear edge projection 142 will then be of greater than standard width. In such a case, the gap 141 will necessarily have to be widened to accommodate the projection 142 of an interconnected link since such projection passes through the open gap 141 at an angle so as to have the major surfaces of adjacent link elements in surface contact. One advantage of this variation is that fewer link elements are necessary per unit length of rope chain.

FIG. 23 is a plan view of a link element 127 similar to that shown in FIG. 22, but with an opening 128 in the projection 129, serving to reduce the amount of precious metal in the finished rope chain and to add a degree of delicateness.

An alternative variation, not shown, the double bump projection 142 of FIGS. 22 and 23 may be disposed on the interior edge of a link element, leaving the exterior edge smooth. The structure of the finished rope chain will be just as tightly interlinked, but the diameter of the finished rope chain will be equal to the diameter of a rope chain made with all standard annular link elements. Such a jewelry item will have all the same visual properties and size dimensions, yet less precious metal is needed, saving manufacturing costs.

Figure 24:
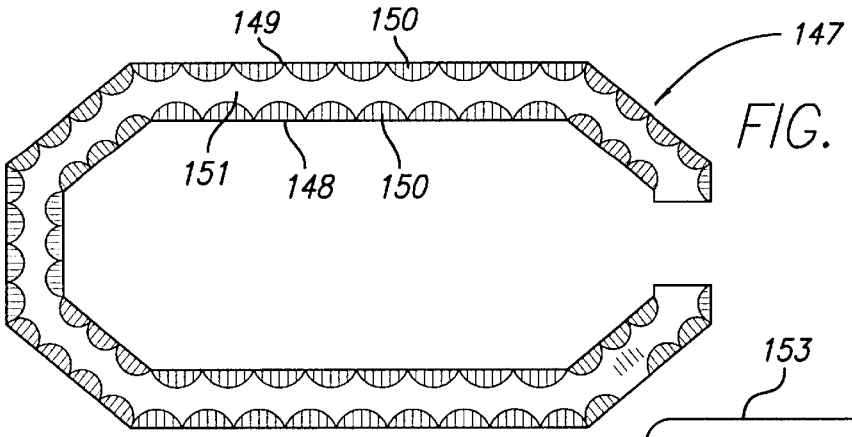
Figure 25:
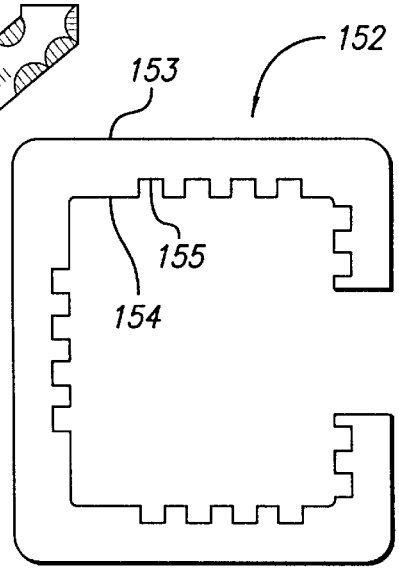
Figure 26:
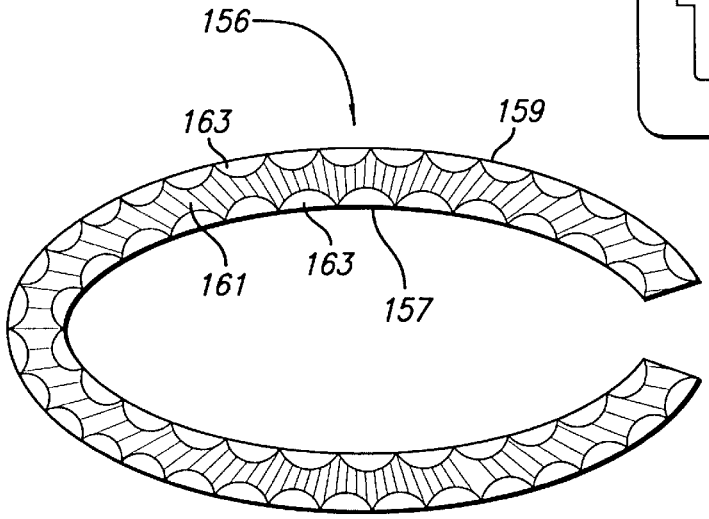
Figure 27:
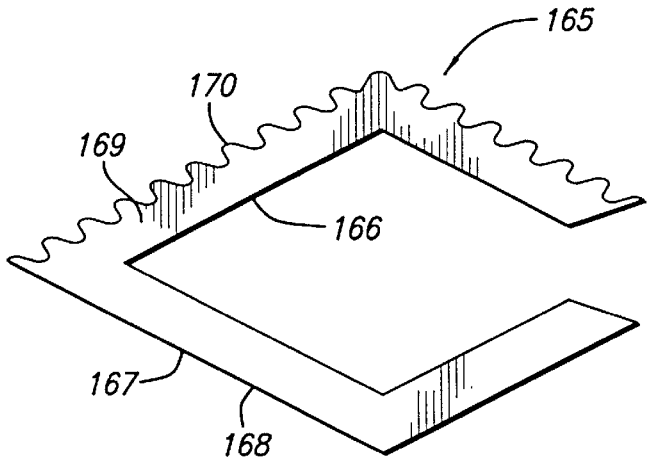
Figure 27A:
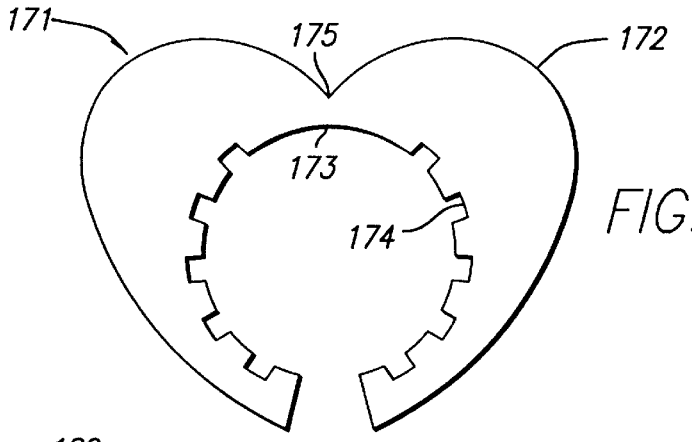
FIG. 27A shows a heart shaped link element configuration.

FIGS. 24–27A show alternate configurations for the gapped link elements relative to the typical annular configuration. The link element of FIG. 24 is baguette shaped, that of FIG. 25 is square shaped, that of FIG. 26 is oval shaped, that of FIG. 27 is diamond shaped, and that of FIG. 27A is heart shaped. Any combination of annular, baguette, square, oval, diamond, heart, or other geometric shaped gapped link elements may be assembled in a virtually limitless variety of combinations to create interesting rope chain jewelry items in accordance with the concepts and methodology of the present invention. For example, a particularly beautiful rope chain design uses a combination of baguette and annular link elements along the length of the chain.

More specifically, FIG. 24 is a plan view of a link element 147 similar to that shown in FIG. 11, but having a generally baguette configuration and having a smooth interior edge 148, a smooth exterior edge 149, and depressions, or raised regions, 150 displaying a visual property other than planar. Preferably, the depressions or raised regions 150 are areas where material has been removed, leaving a central major surface region 151 planar.

FIG. 25 is a plan view of a link element 152 similar to that shown in FIG. 9, but with a generally square configuration and having a smooth exterior edge 153 and a crenelated interior edge 154 defined by crenels 155.

FIG. 26 is a plan view of a link element 156 similar to that shown in FIG. 10, but having a generally oval configuration and having a smooth interior edge 157, a smooth exterior edge 159, and a groove, or raised region, 161 displaying a visual property other than planar. Preferably, the groove or region 161 is where material has been removed, leaving inner and outer planar surfaces 163.

FIG. 27 is a plan view of a link element 165 similar to that shown in FIG. 6, but the interior edge 166 is smooth (non-shaped) having the general configuration of a diamond, with one half 167 of the link element 165 having a smooth exterior edge 168 and the other half 169 having an undulated exterior edge 170.

FIG. 27A is a plan view of a link element 171 similar to that shown in FIGS. 9 and 25, but with a generally heart shaped configuration and having a smooth exterior edge 172 and a crenelated interior edge 173 defined by crenels 174. The amount of precious metal removed at the location of the crenels 174, together with that removed at the cusp 175 at the top as shown in FIG. 27A, is preferably greater than the material added to form the rounded tops on either side of the cusp 175. The net decrease in material results in a less expensive link element while creating a beautiful and symbolic rope chain design.

Figure 28:
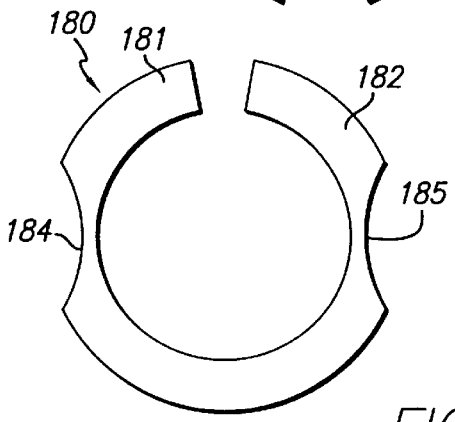

FIG. 28 shows a link element 180 in which an arcuate concave cut 184, 185 is made in each side 181, 182, respectively. In the complete rope chain constructed of a series of link elements 180, a helical groove can be seen on top of each simulated helical strand (such as strands 7 and 8 in FIG. 3). The helical groove divides the helix in two, imparting to the rope chain the appearance of having four helixes instead of two using standard link elements such as that shown in FIG. 1.

Figure 28A:
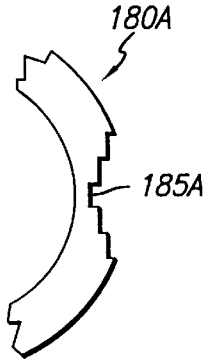
FIG. 28A is a partial plan view of a link element variation of the link element shown in FIG. 28.

FIG. 28A is a partial plan view of a link element 180A which is a variation of the link element 180 of FIG. 28. In FIG. 28A, the arcuate concave cut 185A is stepped. This creates an interesting multi-faceted helix along one of the intertwining rope strands, which is especially attractive, especially when the flat stepped surfaces are rhodium coated. If both sides of link element 180A are concave and stepped as shown, a helical groove can be seen on top of each simulated helical rope strand (such as strands 7 and 8 in FIG. 3).

Figure 29:
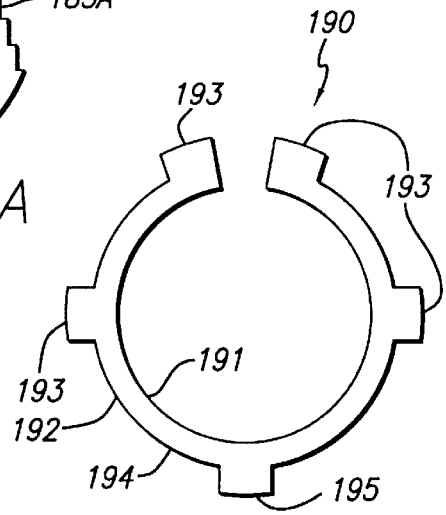

FIG. 29 shows a link element 190 having a smooth interior edge 191 and a crenelated exterior edge 192. The annular width of each wide portion 193, 195 is of standard dimension, while major portions of the exterior edge 192 are removed to produce long crenels 194. Wide rear portion 195 abuts the interior edge of an adjacent link in the series so as to produce a tightly interlinked rope chain. Here, significant precious metal is removed, and yet the effective overall diameter of the finished rope chain appears to be of standard diameter with a number of interesting looking helical ribs (due to the wide portions 193) along the length of the chain.

Figure 30:
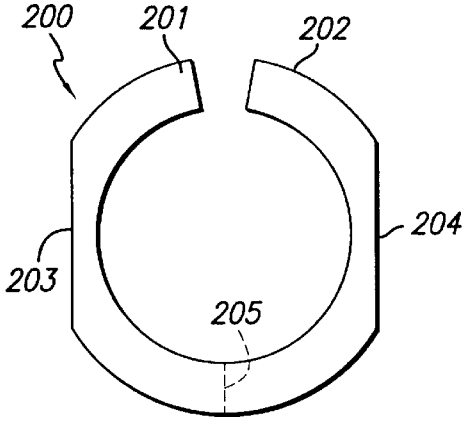

FIG. 30 shows a link element 200 similar to that of FIG. 28, but with flat, rather than concave, cutouts 203, 204 on the sides 201, 202. As a result, the finished rope chain has the appearance of flat helixes alternating with convex helixes along the chain. This variation gives the effect of a diamond cut being made after the rope chain is assembled. By employing precut link elements, the time and expense of a complex diamond cutting process after a rope chain is fully assembled is avoided. Additionally, the precious metal savings is controlled using precut link elements, while collecting and reprocessing shavings from a diamond cutting process has obvious waste and high labor cost disadvantages.

An improvement in the appeal and beauty of a rope chain made with link elements 201 in FIG. 30 is achieved by constructing the link element to have two separate side halves 201 and 202 of different colors/materials connected at the dashed line 205. For example, in FIG. 30, the left half 201 may be made of white gold, the right half 202 of yellow gold, and the straight cutout 204 may be rhodium coated.

Figure 31:
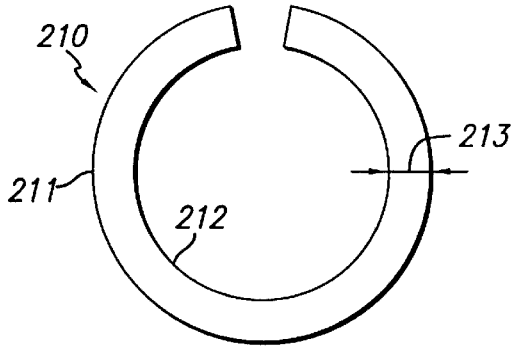

FIG. 31 shows a link element 210 having smooth exterior and interior edges 211, 212, the annular width 213 of which is less than standard. By combining link element 210 with standard link elements, such as that shown in FIG. 1, or with link elements having an enlarged (equal or greater than standard) rear annular width, such as that shown in FIGS. 22 and 23, a tightly, or reasonably tightly, formed rope chain results. Both narrow and wider links have the same inner diameter measured at the location of the gap 3 (FIG. 1). When placed together, the interior openings in the center of the link elements 210 will line up perfectly. The narrower link 210 will be covered by the standard link 1, saving precious metal. For example, links 210 may alternate with links of any other design or shape such as those shown in the accompanying figures, or sets of links 210 may be assembled alternately with sets of other such links. In any event, employing link elements 210 in a rope chain will reduce the amount of precious metal used.

It will be understood that, when link elements having edge designs or patterns, such as those shown in FIGS. 16–19 and 34–36, are assembled, they should not be placed against one another. Otherwise, the designs or patterns will be covered up by adjacent link elements. Link elements 210 are perfectly suited for spacing out the aforementioned link elements having edge designs or patterns.

Figure 32:
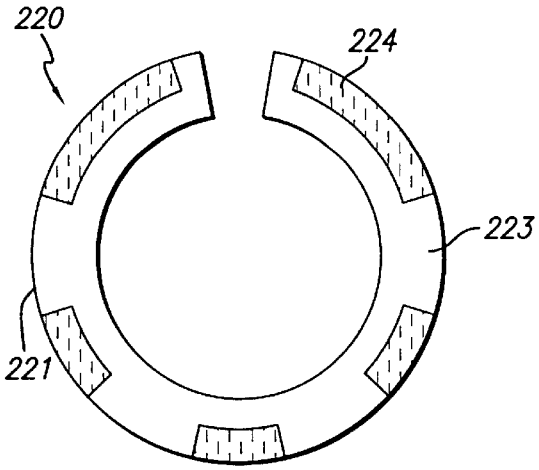
Figure 33:
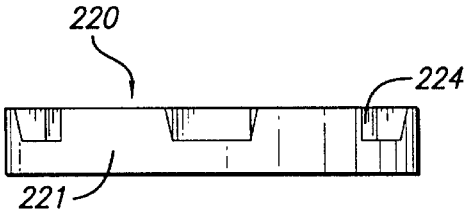

FIGS. 32 and 33 show plan and side elevational views of a link element 220 with notches 224 along the exterior edge 221. When viewed alone, the link element 220 looks incomplete, but when two of the same link elements are viewed together, the notches 224 are covered by the other link. This saves on the use of precious metal, which in turn, reduces cost of this type of rope chain. The notches, or depressions 224 are strategically spaced around the periphery of the link such that they will be hidden from view in a finally assembled rope chain. Due to the overlapping of links, only areas 223 between notches will be visible. The particular pattern of notches may be empirically determined by assembling standard links and making regions that are visible and thus not to be removed.

Figure 34:
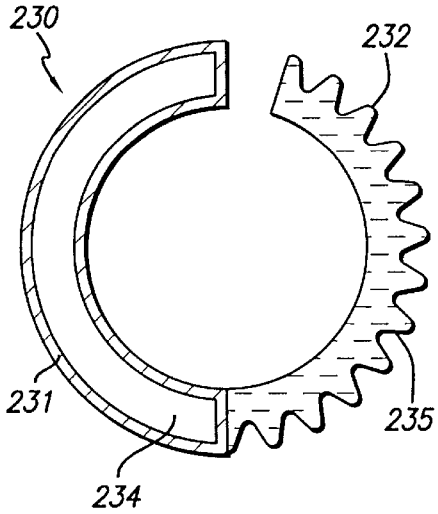

FIG. 34 shows a link element 230 having a side 231 of a first material and an opening 234 therein, and a side 232 of narrow annular width with undulations 235 and of a second material. This example combines material differences, annular width differences, and material removal pattern differences in the two sides 231, 232.

Figure 35:
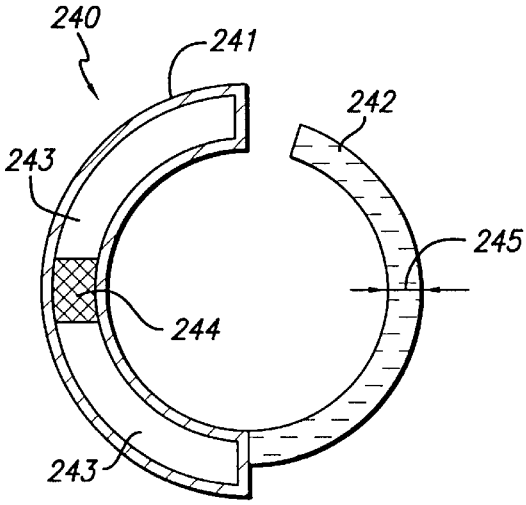

The link element 240 of FIG. 35 has a first side 241 made of a first material and having arcuate openings 243 therein separated by a solid annular segment 244 made of a second material, the side 241 being of standard annular width. The second side 242 is of a third material and of a narrowed annular width 245.

Figure 36:
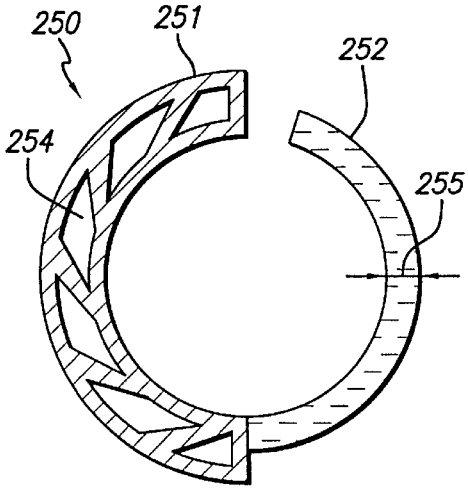

FIG. 36 shows a link element 250 having a side 251 of a first material and with a plurality of spaced differently shaped openings 254. The other side 252 is made of a second material and has a narrower-than-standard annular width 255.

Figure 37:
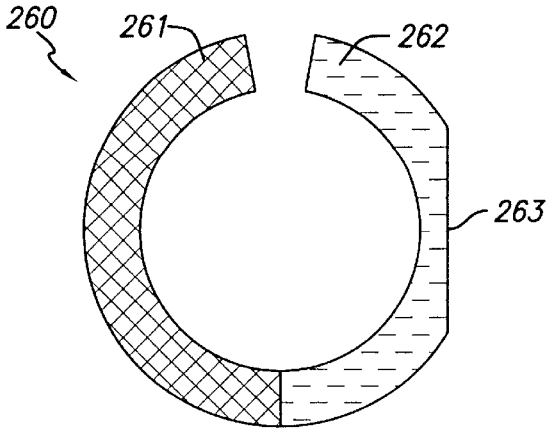

FIG. 37 shows a link element 260 having a side 261 of a first material and of standard configuration, i.e., as an annular segment. The other side 262 is made of a second material and has a flat edge 263. When a number of links 260 are assembled into a rope chain, one of the helical strands will be standard, and the other helical strand will have all of the flat edges 263 of the link elements lying in a helix following the helix formed by the link half 262.

After a rope chain is formed using link elements having a shape as shown in FIG. 37, the entire right half 262, for example of white gold, or only the flat edges 263 may be rhodium coated (or coated with other metallic coatings or with enamel). For example, if the left side 261 of link element 260 were made of yellow gold, and the right side was made of white gold, only the flat edge 263 of the white gold side 262 may be rhodium coated. This results in a very unique rope chain in which one helical rope strand is yellow gold along the entire length of the chain, and the other helical rope strand is white gold with a brilliant and shiny center. As shown in FIG. 37, a substantial part of the white gold rope strand will exhibit the shiny rhodium finish. By making the flat edge 263 shorter, a more delicate looking rope chain results, with the appearance of tiny flashes of brilliance evident as the rope chain is moved relative to a light source. Such a rope chain design and appearance cannot be manufactured using standard annular link elements throughout and then diamond cutting an edge on the finished chain, since the diamond cutting process will cut both helical strands, not just one.

Figure 38:
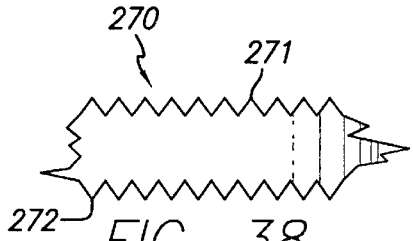

FIG. 38 is a partial side elevational view of a link element 270 in which one or both of the textured major surfaces 271,272 are serrated, or knurled. The maximum link thickness, including the tips of the knurls, equals the thickness of a standard annular link element, thereby reducing the amount of precious metal used in the manufacture of the link element.

Figure 39:
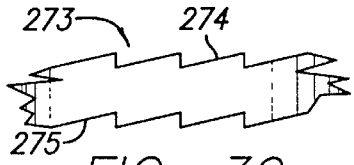
Figure 43:
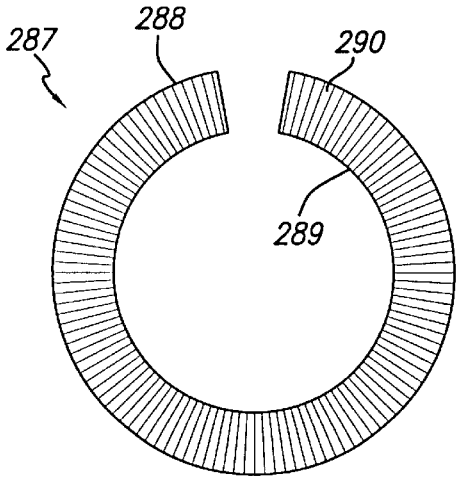

FIG. 39 is a partial side elevational view of a link element 273 in which one or both of the textured major surfaces 274,275 have connected angled plate-like segments producing a saw-toothed profile. Again, the maximum thickness, including the tips of the saw-toothed plates, equals the thickness of a standard annular link element, thereby reducing the amount of precious metal used in the manufacture of the link element.

Figure 40:
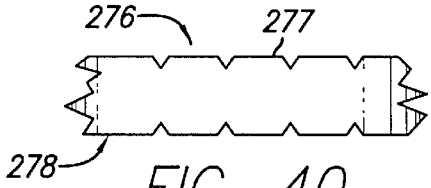
Figure 41:
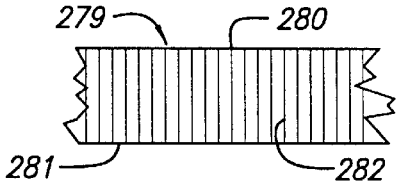
Figure 44:
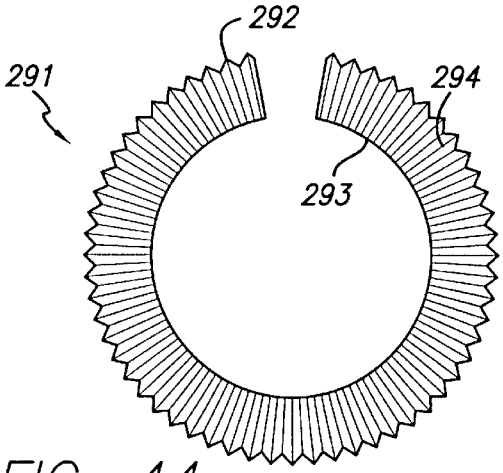
Figure 42:
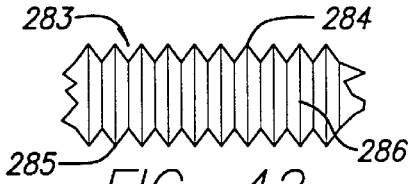

FIG. 40 is a partial side elevational view of a link element 276 of standard thickness, in which one or both of the textured major surfaces 277,278 have V-shaped grooves therein, serving to reduce the amount of precious metal used in the manufacture of the link element.

FIGS. 41–44 depict, in partial elevational and full plan views, link elements having one or both major surfaces and/or one or both of the interior and exterior edges serrated, or knurled. The link element 279, for example possesses smooth upper and lower major surfaces 280,281 and a serrated, scored, or knurled, interior or exterior edge 282. Link element 283 has both major surfaces 284, 285 serrated, scored, or knurled, as well as the internal or exterior edge 286. Link element 287 has planar smooth exterior and interior edges 288,289, and a serrated, scored, or knurled, upper or lower major surface 290. The link element 291 has a serrated, scored, or knurled, exterior edge 292, a smooth interior edge 293, and a serrated, scored, or knurled, upper or lower major surface 294.

For convenience of presentation, the major surfaces and/or interior and exterior edges shown in FIGS. 41–44 are shown as serrated, or knurled. It is to be understood, however, that these surfaces may have physical surface appearances other than serrated, scored, or knurled, such as textured, patterned, sandblasted, etched, shaped, polished, matted, frosted, diamond cut, or otherwise mechanically deformed.

In addition to presenting a softer visual appearance to a completed rope chain, combining serrated, scored, or knurled, link elements selected from those shown in FIGS. 41–44 with any of the other link element variations shown and described herein creates unusual and attractive jewelry items.

Additionally, it is known to diamond cut the edges of a completed rope chain and coat with rhodium (or other material) the flattened surfaces created by the diamond cutting process. By constructing a rope chain using, in part or in whole, serrated, scored, or knurled, link elements, and subsequently rhodium coating diamond cut surfaces, a dramatic increase in contrast is seen due to the softer yellow gold color of the serrated, scored, or knurled portions and the mirror-like finish of the coated diamond cut portions of the chain.

Figure 45:
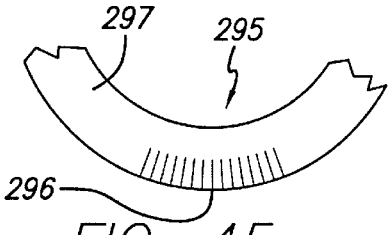

FIG. 45 is a partial plan view of a link element 295 having portions 297 of its major surface smooth and portions 296 serrated, scored, or knurled. This figure is presented to show the possibility that any portion of a link element may be serrated, scored, or knurled, and such portion may, but need not, span the entire link width or span the entire extent of the link element. Similarly, any color, texture, or pattern on a major surface, or on the interior or exterior edges, of a link element may purposely be limited to only a portion thereof at the discretion of the rope chain designer/manufacturer.

As has been suggested by the various embodiments and variations of the invention presented herein, the flexibility of design, appearance, and feel of a rope chain manufactured using the link elements shown and described can stimulate a myriad of possibilities. These attributes of a completed rope chain can be unique with the present invention. Creating similar attributes using prior art techniques would not be considered by the person of ordinary skill in the art, since all attempts to similarly shape, color, texture, or pattern a rope chain after it is completed would not be practical. The uniqueness of a rope chain employing the link elements of the present invention is made possible by the provision of pre-formed, pre-shaped, or otherwise pre-processed individual link elements. Exclusive finished rope chain attributes made possible with the present invention cannot be duplicated by applying post-processing steps, whether a single type link element is used throughout the length of the rope chain, or multiple types of link elements are assembled in a particular or random order.

To illustrate the great extent to which different visual impressions are made possible with the invention, the individual visual properties of different link element types can be appreciated in the same rope chain by assembling combinations of different link element types. Considering only four of the types of link elements depicted in the accompanying drawing, FIGS. 1, 28, 30, and 37, a mix of link elements of any desired order can be used to create a rope chain design which cannot be duplicated by prior art methods. For example, if a length of rope chain comprises link elements of FIGS. 28 and an adjacent length of rope chain comprises link elements of FIG. 30, the notched edges 184, 185, 203, 204 form a continuous "apparent" helix. Advantageously, however the light reflecting off the concave notches 184, 185 is visually different from the light reflecting off the flat notches 203, 204, especially if optionally rhodium coated. Obtaining this interesting visual effect after a rope chain made with conventional "standard" annular links is practically impossible, since any diamond cutting of the finished chain would be consistent along the entire length of the chain.

Similarly, another visually pleasing rope chain can be manufactured by assembling a chain length, e.g. one inch, of link elements of the FIG. 30 type adjacent a length of assembled link elements of the FIG. 37 type. In this variation, one of the helixes along the length of the chain will be continuous, and the other helix will be intermittent.

Figure 46:
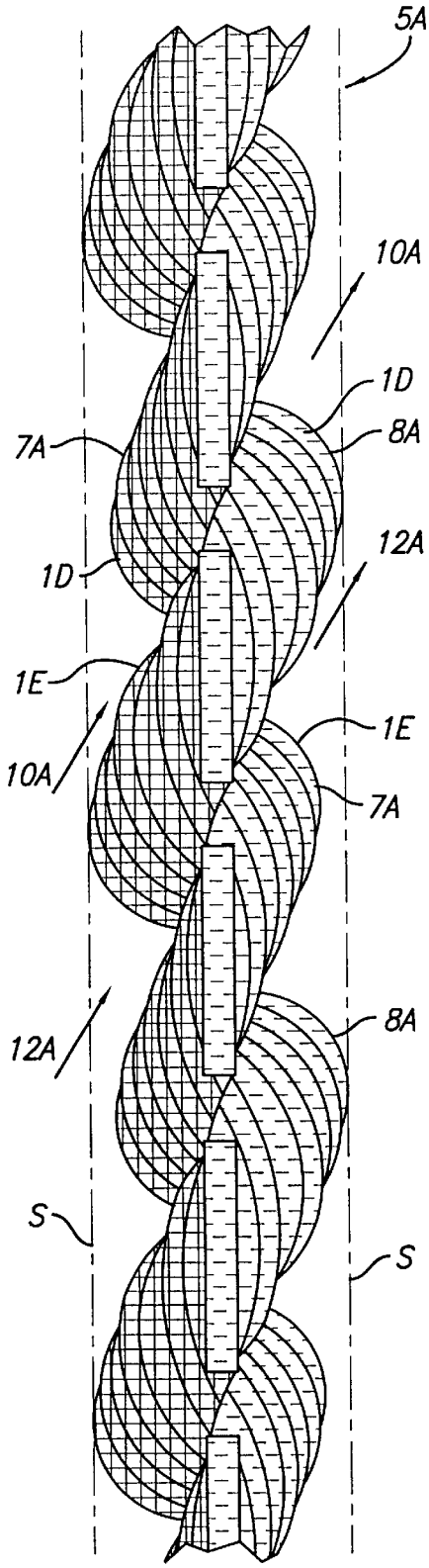
FIG. 46 is a length of rope chain in which each link element comprises differently sized segments resulting in one of the apparent rope strands being of a larger diameter than the adjacent strand.
Figure 47:
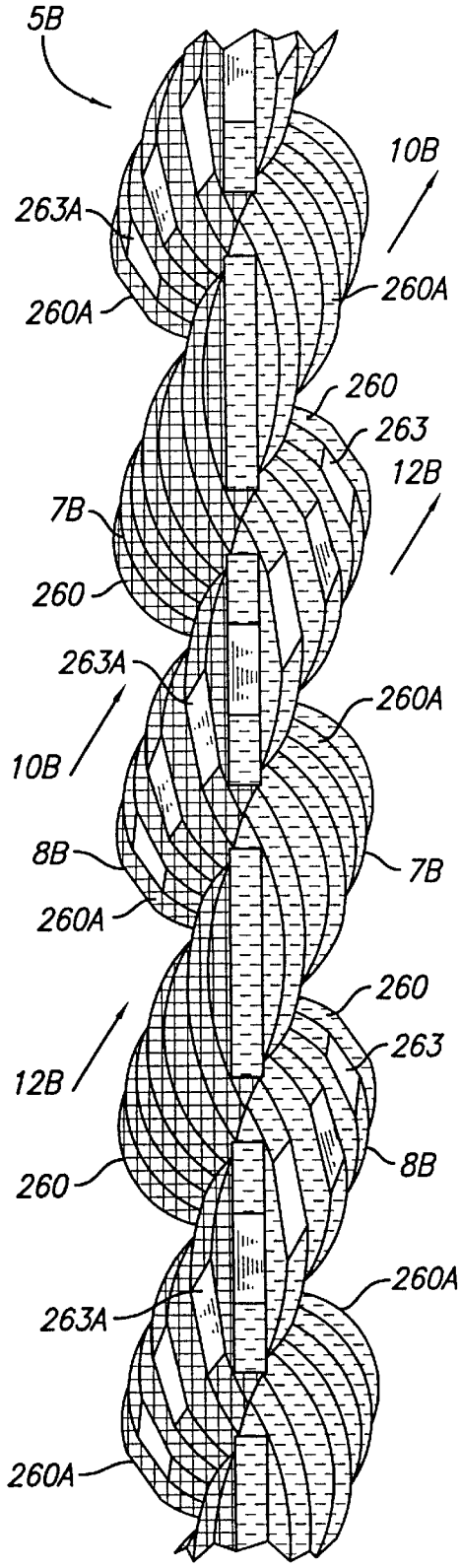
FIG. 47 is a length of rope chain in which each link element comprises differently shaped segments resulting in one of the apparent rope strands exhibiting a much different visual property than that of the adjacent strand.

For two other examples of the unique and visually interesting effects achievable using the concepts of the present invention, reference is made to FIGS. 46 and 47.

As suggested herein, any visual property, as defined herein, may be combined with any one or more other visual properties in the manufacture of the various link elements making up the completed rope chain.

FIG. 46 is an example of a length of rope chain 5A constructed using any of the link elements described herein in which the links are segmented into large and small width segments. The specific variation shown in FIG. 46 uses link element 75 (FIG. 14) or 85 (FIG. 15) where the narrow side 76 or 86 is made of a different material or is of a different color than that of the wider side 77 or 87.

The link elements are selected and assembled so that link elements 1D have a white gold wide side 77 or 87 and a yellow gold narrow side 76 or 86. Link elements 1E have a yellow gold wide side 77 or 87 and a white gold narrow side 76 or 86. Thus, strand 7A has a smaller diameter rope strand appearance, and strand 8A has a larger diameter rope strand appearance. Along channel 10A, the smaller helical strand 7A is on the left and the larger helical strand 8A is on the right. The opposite location of the larger and smaller helical strands is true for channel 12A. With this choice and arrangement of link elements, each rope strand 7A and 8A alternate yellow and gold materials along their respective lengths. The size difference for the two helixes are evident by reference to the two dashed lines "S" on either side of the rope chain 5A illustrated in FIG. 46.

FIG. 47 shows a length of rope chain 5B constructed with link elements 260 shown in FIG. 37 mixed with similar link elements 260A, the latter being identical to link elements 260 except that the yellow and white gold materials are switched.

As seen in FIG. 47, rope strand 7B alternates white and yellow along its length and has a standard annular link element appearance. On the other hand, rope strand 8B alternates white and yellow along its length, but each link element along the strand has a flat side 263 (white gold side) and 263A (yellow gold side) creating a single helix within only one of the standard rope chain strands 8B.

Along channel 10B, a standard helical rope strand 7B lies on the left of the channel, and a helical rope strand 8B with a compound helical series of flat surfaces lies on the right. The opposite is seen left and right along channel 12B.

It was mentioned above that certain prior art, e.g. U.S. Pat. Nos. 5,425,228 and 5,285,625, shows link configurations which reveal flattened sides, the latter patent showing the effects of such flattened sides in FIG. 5 thereof. However, neither of these patents teach constructing a rope chain which has two visually different helixes. The present invention teaches that employing link elements having particular visual appearances, and assembling them in accordance with a particular method of linking, will advantageously result in one helix having a different visual appearance than that of the other helix. The result of applying the particular method is illustrated in the completed rope chains of FIGS. 46 and 47, already described. Details of the particular method used to create helixes of differing visual appearances in the same rope chain jewelry piece are presented below having reference to FIGS. 48A–D and 49A–D.

In FIGS. 48A–D, a number of identical link elements are interconnected in a special way, each link element 301–304 comprising a standard segment half 301A–304A and serrated segment half 301B–304B. Both major surfaces and interior and exterior edges of segments 301B–304B are serrated so as to make the two halves of each link notably different in visual appearance.

Also, although a six or eight link set is preferred in the construction of a rope chain, only a four link set is shown in FIGS. 48A–D for convenience of drawing and simplification of description. Additionally, in the following description, it will be understood that each link element has a gap G without having to complicate the drawing to show each gap of each link element. Extrapolating the method of assembling the links to a six and eight link set will be clear to a person of ordinary skill in the art.

As will be demonstrated, the relative orientation of the links forming the rope chain is important to achieve the desired results.

Figure 48A:
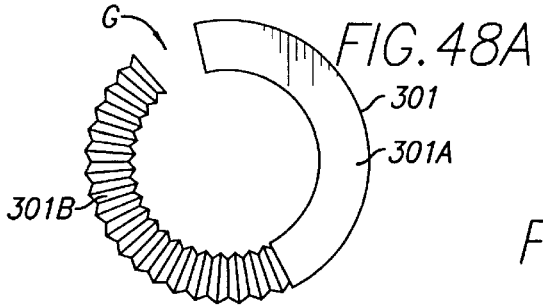
FIGS. 48A–D show a length of rope chain in which a number of identical link elements are interconnected in a special way, each link element having a standard segment half and a serrated segment half.
Figure 49A:
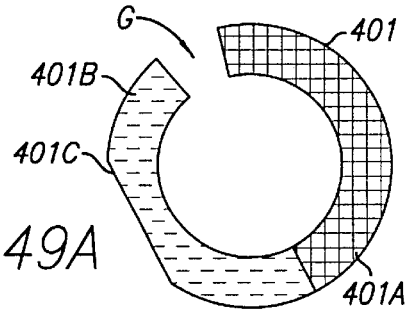
FIGS. 49A–D show a number of identical link elements interconnected in a special way, each link element having an annular yellow gold segment half and an annular white gold segment half with a portion cut away defining a single planar side.

In FIG. 48A, link 301 is initially oriented so that its gap G faces a predetermined direction, e.g., facing generally upwardly, with the standard annular link segment 301A on the right (as viewed on the page) and the serrated annular link segment 301B on the left.

Figure 48B:
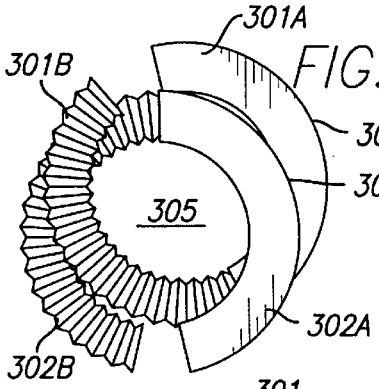
Figure 49B:
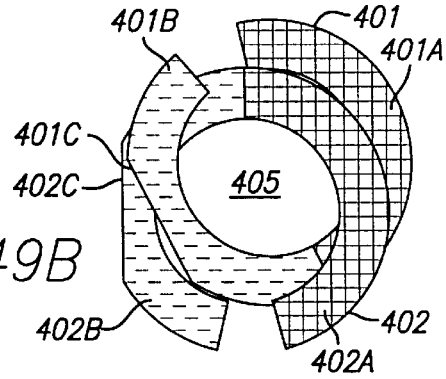

The second link 302 of the series is then passed through the gap of link 301, with the gap of link 302 facing downwardly at about 180° relative to the gap of link 301, as shown in FIG. 48B. It should be observed that, before placement, the second link 302 is either rotated 180° and then flipped horizontally, or not rotated but flipped vertically relative to the orientation of link 301, so as to orient the standard and serrated segments 302A and 302B on the same side of the assembly as segments 301A and 301B, respectively.

Links 301 and 302 are then juxtaposed and intertwined so that they lay against each other, with the outer periphery of the link 302 lying against the inner periphery of link 301, to the greatest extent possible, thereby creating a relatively large central opening 305 within the pair of intertwined and abutting annular links 301,302. The plane of link 301 lies parallel to the plane of the paper, and the plane of link 302 is slightly skewed from the plane of link 301.

Figure 48C:
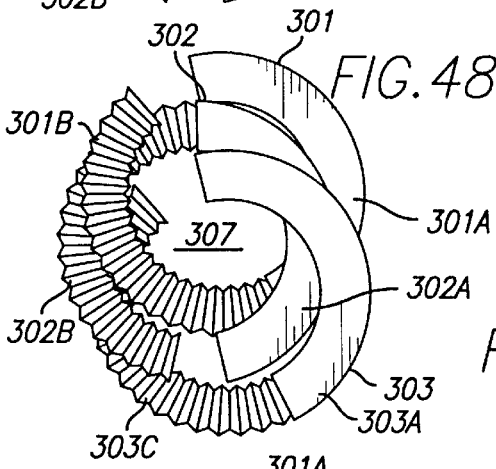
Figure 49C:
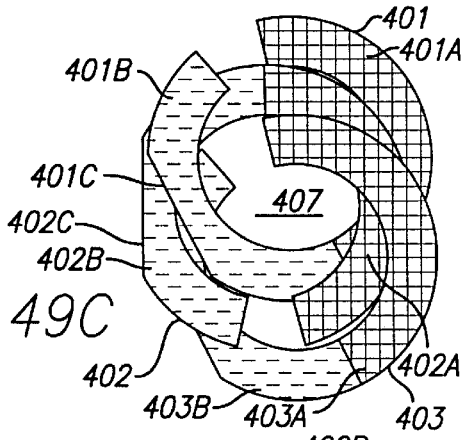

The gap G of the third link 303 is then passed through the gap G of link 302 and over the interior edge of link 301 and laid angularly against links 301 and 302. The gap G of link 303 has the same orientation as the gap G of link 301, and the segments 303A and 303B are oriented the same as link segments 301A and 301B, respectively, as shown in FIG. 48C. The plane of link 303 is more greatly skewed than links 301 and 302. A central opening 307 still remains within the now three intertwined links 301, 302, and 303. The plane of each of the links differs from each other 180° divided by the number of links in a set.

Figure 48D:
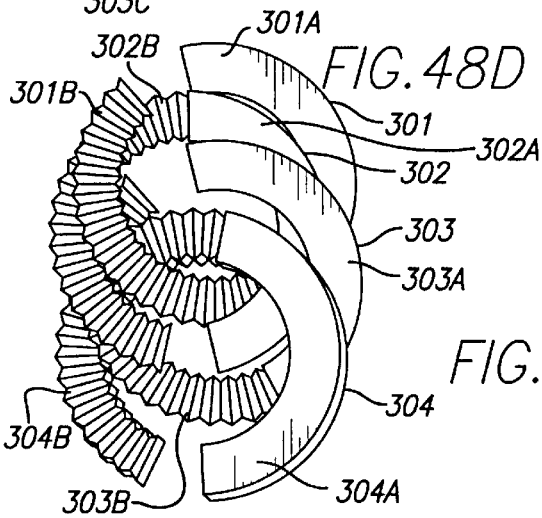
Figure 49D:
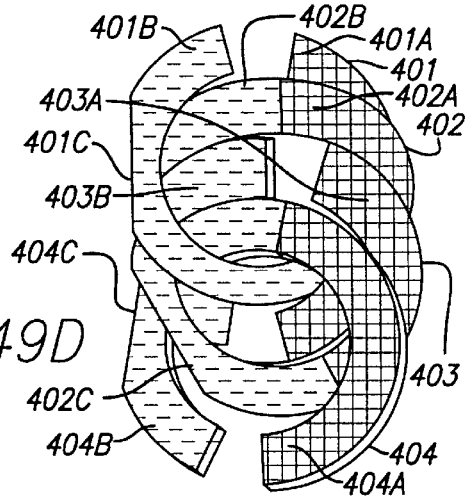

As seen in FIG. 48D, the gap G of a fourth link 304 is passed over links 301, 302, and 303, through the center opening 307 (FIG. 48C), and thereby envelopes links 301, 302, and 303. The gap G of link 304 is disposed in the same orientation as the gap G of link 302. The link segments 304A and 304B are oriented the same as link segments 302A and 302B, respectively, as shown in FIG. 48D. Link 304 is then laid against the other links 301–303, and its plane lies at approximately the same angle from the plane of link 303 as that between the other adjacent links.

Extrapolating the above assembly procedures to a six or eight link set, and repeating the procedure for adjacent sets of links, produces a very beautiful rope chain jewelry piece with an apparent pair of differently designed rope strands. That is, one of the intertwined helixes has the visual appearance of a standard rope chain helix, and the other helix exhibits serrations on all of its visible surfaces.

In FIGS. 49A–D, a number of identical link elements are interconnected in a special way, each link element 401–404 comprising an annular yellow gold segment half 401A–404A, and an annular white gold segment half 401B–4042 with a portion cut away defining a single planar side 401C–404C. In this variation, the links have different colored segments in addition to having differently shaped segments to make the two halves of each link, and each helix of the completed rope chain, notably different in visual appearance.

The description of the assembly procedure for FIGS. 49A–D is the same as that for FIGS. 48A–D, except that, in the resultant completed rope chain, one of the intertwined helixes has the visual appearance of a standard yellow gold colored rope chain helix, and the other helix has the visual appearance of a white gold helix with a helix of angularly changing planar portions running through the middle of the white gold helix. The planar helix visual effect may be enhanced by either diamond cutting the surface 401C–404C and/or rhodium coating such planar surface 401C–404C. Again in this variation, the links have different colored segments in addition to having differently shaped segments to make the two halves of each link, and each helix of the completed rope chain, notably different in visual appearance.

The embodiments of the invention shown in FIGS. 6–49 provide a basis for appreciating the virtually limitless number of configurations and shape and design patterns that can be produced in a rope chain structure by employing and creatively arranging the differently colored, patterned, textured, and/or shaped link elements such as those depicted in FIGS. 6–49. Further variations and combinations of color patterns, textures, shapes, and configurations are possible and presumed to be within the teaching of the present invention.

Obviously, color, shape, texture, and overall configurations other than those shown in FIGS. 6–49 are possible for the manufacture of the link elements, and these are merely examples of preferred visual property combinations which can produce striking results in a finished rope chain construction. For example, an interesting variation of an undulated shaped edge would be a scalloped edge. Accordingly, it is to be understood that the shape and design patterns shown in FIGS. 6–49, the types of materials used, the coloring, surface texture, surface patterns, arrangement of groups and sets of link elements along the rope chain, reversed or not, randomly assembled or in strict accordance with a repeated pattern, and the like are all contemplated possibilities and are to be considered within the scope of the present invention.

It will be understood that the surface colors, textures, patterns, and/or shapes of the gapped link elements 147, 152, 156, 165 in FIGS. 24–27A may be as varied as those features of the annular link elements described herein and shown in FIGS. 6–23 and 28–49.

While only certain embodiments have been set forth, alternative embodiments and various modifications will be apparent from the above description to those skilled in the art. For example, while the colors and precious metals used in the descriptions herein are preferred to be yellow, white, rose, and green gold, other colors and metals, or even nonmetals, can be employed in the construction of the disclosed rope chain configurations. Notable alternate materials, for example, are rhodium (in various colors), silver, and nickel, either solid or plated. Colored coatings may also be applied, such as enamel or powder coating.

Several references to rhodium coating have been made in this description. It is to be understood that virtually any part of a finished rope chain, constructed from any of the link elements shown in FIGS. 6–49 can be rhodium coated, or coated with any other preferred material or substance. Alternatively, if a rope chain is made without the application of heat to weld, or otherwise attach, adjacent link elements together, rhodium (or other material or substance) coating can be applied to the individual link elements prior to assembly, saving much labor expense which would otherwise be required with post assembly coating processes.

In the examples herein showing segmented link elements with one side having different physical characteristics than the other side, the drawings and accompanying text referred to the transition being opposite the placement of the gap. It is within the scope of the present invention to provide segmented regions having different physical characteristics or properties as described herein placed in other positions along the extent of the link elements. One example is providing a dividing line horizontally positioned in any of FIGS. 6–45. These and other alternatives are considered equivalents and within the spirit and scope of the present invention.

What is claimed is:

1. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

link width is defined as a distance, measured along either of said major surfaces, between a pair of parallel lines perpendicular to said major surfaces and tangent to, respectively, said interior and exterior edges;

at least some of said link elements in the length of rope chain are divided into segment halves along the extent of said link element;

a first one of said segments has an annular shape and is of constant link width; and a second one of said segments has a link width greater than the link width of said first annular segment.

2. The improvement as claimed in claim 1, wherein:

each of said link elements that is divided into segments exhibits an irregular visual property along its extent; and each said link element that is divided into segments is additionally divided into portions, not necessarily coincident with said segments, in number or placement, each said portion possessing a unique visual property relative to an adjacent portion.

3. The improvement as claimed in claim 2, wherein:

each said portion is made of a different material than an adjacent segment.

4. The improvement as claimed in claim 2, wherein:

one of said portions is one color or texture and of one shape; and another of said portions is another color or texture and of another shape.

5. The improvement as claimed in claim 2, wherein:

one of said segments has a smooth interior edge and a smooth exterior edge; and another of said segments has a smooth interior edge and an undulated exterior edge.

6. The improvement as claimed in claim 2, wherein said second segment has a constant relatively narrow link width, and said second segment has a constant relatively wider link width.

7. The improvement as claimed in claim 2, wherein:

each said segment has a first end and a second end; and said second segment gradually increases to a relatively wider width intermediate its ends.

8. The improvement as claimed in claim 7, wherein width of said second segment is nonlinear so as to narrow down to the width of said first segment at a location where said first segment and said second segment are joined.

9. The improvement as claimed in claim 2, wherein said second segment has an opening formed therein.

10. The improvement as claimed in claim 2, wherein said second segment is made of a first material, a portion of said second segment forming a frame defined by an opening formed therein, and another portion of said second segment filling at least a portion of said opening and being made of a second, different, material.

11. The improvement as claimed in claim 2, wherein said second segment has an opening formed therein to define a framed segment portion with a plurality of tendril-like filigree filaments bridging across the opening.

12. The improvement as claimed in claim 2, wherein said second segment has a plurality of symbols formed in a major surface thereof.

13. The improvement as claimed in claim 12, wherein said symbols are heart shaped.

14. The improvement as claimed in claim 2, wherein:

one of said segments has an undulated exterior edge; and another one of said segments has a crenelated interior edge.

15. The improvement as claimed in claim 2, wherein:

one of said segments is annular with smooth interior and exterior edges; and another one of said segments has a crenelated interior edge.

16. The improvement as claimed in claim 2, wherein said second segment has at least one opening therein, and said first segment has undulations on its exterior edge.

17. The improvement as claimed in claim 1, wherein each of said link elements that is divided into segments exhibits an irregular visual property along its extent, and has a repeating visual property pattern along its extent.

18. The improvement as claimed in claim 1, wherein one of said segments has an undulated exterior edge.

19. The improvement as claimed in claim 1, wherein one of said segments has a crenelated interior edge and at least a partially undulated exterior edge.

20. The improvement as claimed in claim 1, wherein one of said segments has a smooth exterior edge and a crenelated interior edge.

21. The improvement as claimed in claim 1, wherein:

said second segment is made of a first material with openings therein, said openings separated by a solid portion of a second material; and said first segment is made of a material different from one of said first and second materials.

22. The improvement as claimed in claim 1, wherein:

said second segment is made of a first material and has a plurality of spaced differently shaped openings therein; and said first segment is made of a second material.

23. The improvement as claimed in claim 1, wherein at least a portion of one of said major surfaces of each of said link elements that is divided into segments is textured in the form of at least one of the group consisting of a serrated surface, a sandblasted surface, a series of angled plate-like surfaces having a saw-toothed profile, V-shaped grooved surface, and a diamond cut surface.

24. The jewelry rope chain as claimed in claim 1, wherein at least a portion of one of said first major surface, second major surface, interior edge, and exterior edge of each of said link elements that is divided into segments is textured in the form of at least one of the group consisting of a serrated surface, a sandblasted surface, a series of angled plate-like surfaces having a saw-toothed profile, V-shaped grooved surface, and a diamond cut surface.

25. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

link width is defined as a distance, measured along either of said major surfaces, between a pair of parallel lines perpendicular to said major surfaces and tangent to, respectively, said interior and exterior edges; and selected ones of said link elements have an irregular link width and have a substantially C-shape configuration defining a gap, with a lateral projection formed on one of said interior and exterior edges thereof opposite the position of the gap in the link element.

26. The improvement as claimed in claim 25, wherein:

each of said selected link elements has sides of a predetermined annular width; and said lateral projection that projects from one of said interior and exterior edges defines an enlarged link width, greater than said predetermined link width, at the location of said projection.

27. The improvement as claimed in claim 26, wherein said lateral projection has two adjacent bumps projecting outwardly from said exterior edge, defining said predetermined link width at a location between said bumps.

28. The improvement as claimed in claim 25, wherein said lateral projection has an opening therein.

29. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

link width is defined as a distance, measured along either of said major surfaces, between a pair of parallel lines perpendicular to said major surfaces and tangent to, respectively, said interior and exterior edges; and at least some of said link elements in the length of rope chain have an irregular link width along the extent of said link element; and each of said link elements that have an irregular link width has an arcuate, concave shaped, textured cutout formed in the exterior edge thereof.

30. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

link width is defined as a distance, measured along either of said major surfaces, between a pair of parallel lines perpendicular to said major surfaces and tangent to, respectively, said interior and exterior edges; and at least some of said link elements in the length of rope chain have an irregular link width along the extent of said link element; and each of said link elements that have an irregular link width has a textured flat planar surface cutout formed in the exterior edge thereof.

31. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

link width is defined as a distance, measured along either of said major surfaces, between a pair of parallel lines perpendicular to said major surfaces and tangent to, respectively, said interior and exterior edges; and some of said link elements in the length of rope chain have a link width less than a predetermined link width, and others of said link elements in the length of rope chain have a link width greater than said predetermined link width.

32. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

one of said major surfaces of at least some of said link elements in the length of rope chain has at least one portion thereof removed, and has at least one other portion intact and undisturbed; and said one major surface has notches or depressions spaced around the exterior periphery thereof and opening into said exterior edge.

33. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

at least some of said link elements in said length of jewelry rope chain are divided into segments;

each said segment is made of a different material than an adjacent segment along the extent of each such link element; and at least one of said segments has a single flat surface formed on its exterior edge parallel to a line passing through a gap in said link element and the center point of said link element.

34. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

at least some of said link elements in said length of jewelry rope chain are divided into segments;

each said segment is made of a different material than an adjacent segment along the extent of each such link element;

one of said segments has a single flat surface formed on its exterior edge parallel to a line passing through a gap in said link element and the center point of said link element; and the segment upon which said flat surface is formed is colored, or textured, or colored and textured differently than that of another segment.

35. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

link width is defined as a distance, measured along either of said major surfaces, between a pair of parallel lines perpendicular to said major surfaces and tangent to, respectively, said interior and exterior edges;

said link elements each have a constant link width along the extent of said link elements;

link thickness is defined as a distance between and perpendicular to planes parallel to said first and second major surfaces; and at least some of said link elements in the rope chain have an irregular link thickness along the extent of said link element, whereby a cross section at one location along the extent of said link element is different in shape than a cross section at another location along the extent of said link element; wherein:

each of said link elements that has an irregular link thickness is divided into segments, each said segment possessing a unique link thickness character relative to an adjacent segment; and each said segment is made of a different material than an adjacent segment.

36. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

link width is defined as a distance, measured along either of said major surfaces, between a pair of parallel lines perpendicular to said major surfaces and tangent to, respectively, said interior and exterior edges;

said link elements each have a constant link width along the extent of said link elements;

link thickness is defined as a distance between and perpendicular to planes parallel to said first and second major surfaces; and at least some of said link elements in the rope chain have an irregular link thickness along the extent of said link element, whereby a cross section at one location along the extent of said link element is different in shape than a cross section at another location along the extent of said link element; wherein each of said link elements that has an irregular link thickness has smooth interior and exterior edges, and a surface discontinuity extending centrally along a major surface of the link element.

37. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

link width is defined as a distance, measured along either of said major surfaces, between a pair of parallel lines perpendicular to said major surfaces and tangent to, respectively, said interior and exterior edges;

said link elements each have a constant link width along the extent of said link elements;

link thickness is defined as a distance between and perpendicular to planes parallel to said first and second major surfaces; and at least some of said link elements in the rope chain have an irregular link thickness along the extent of said link element, whereby a cross section at one location along the extent of said link element is different in shape than a cross section at another location along the extent of said link element; wherein each of said link elements that has an irregular link thickness has smooth interior and exterior edges, and surface discontinuities formed on a major surface of the link element adjacent at least one of said interior and exterior edges, leaving a central portion of the major surface of said link element planar.

38. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

link width is defined as a distance, measured along either of said major surfaces, between a pair of parallel lines perpendicular to said major surfaces and tangent to, respectively, said interior and exterior edges;

said link elements each have a constant link width along the extent of said link elements;

link thickness is defined as a distance between and perpendicular to planes parallel to said first and second major surfaces; and at least some of said link elements in the rope chain have an irregular link thickness along the extent of said link element, whereby a cross section at one location along the extent of said link element is different in shape than a cross section at another location along the extent of said link element; wherein each of said link elements that has an irregular link thickness has smooth interior and exterior edges, and a textured surface discontinuity extending centrally along a major surface of said link element.

39. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

link width is defined as a distance, measured along either of said major surfaces, between a pair of parallel lines perpendicular to said major surfaces and tangent to, respectively, said interior and exterior edges;

said link elements each have a constant link width along the extent of said link elements;

link thickness is defined as a distance between and perpendicular to planes parallel to said first and second major surfaces; and at least some of said link elements in the rope chain have an irregular link thickness along the extent of said link element, whereby a cross section at one location along the extent of said link element is different in shape than a cross section at another location along the extent of said link element; wherein each of said link elements that has an irregular link thickness has smooth interior and exterior edges and textured surface discontinuities formed on a major surface thereof adjacent at least one of said interior and exterior edges, leaving a central portion of said major surface of said link element planar.

40. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

link width is defined as a distance, measured along either of said major surfaces, between a pair of parallel lines perpendicular to said major surfaces and tangent to, respectively, said interior and exterior edges;

said link elements each have a constant link width along the extent of said link elements;

link thickness is defined as a distance between and perpendicular to planes parallel to said first and second major surfaces; and at least some of said link elements in the rope chain have an irregular link thickness along the extent of said link element, whereby a cross section at one location along the extent of said link element is different in shape than a cross section at another location along the extent of said link element; wherein each of said link elements that has an irregular link thickness has smooth interior and exterior edges and at least a portion of one of its major surfaces textured in the form of at least one of the group consisting of a serrated surface, a sandblasted surface, a series of angled plate-like surfaces having a saw-toothed profile, V-shaped grooved surface, and a diamond cut surface.

41. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

link width is defined as a distance, measured along either of said major surfaces, between a pair of parallel lines perpendicular to said major surfaces and tangent to, respectively, said interior and exterior edges;

said link elements each have a constant link width along the extent of said link elements;

link thickness is defined as a distance between and perpendicular to planes parallel to said first and second major surfaces; and at least some of said link elements in the rope chain have an irregular link thickness along the extent of said link element, whereby a cross section at one location along the extent of said link element is different in shape than a cross section at another location along the extent of said link element; wherein each of said link elements that has an irregular link thickness has at least a portion of one of its interior and exterior edges textured in the form of at least one of the group consisting of a serrated surface, a sandblasted surface, a series of angled plate-like surfaces having a saw-toothed profile, V-shaped grooved surface, and a diamond cut surface.

42. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

link width is defined as a distance, measured along either of said major surfaces, between a pair of parallel lines perpendicular to said major surfaces and tangent to, respectively, said interior and exterior edges;

said link elements each have a constant link width along the extent of said link elements;

link thickness is defined as a distance between and perpendicular to planes parallel to said first and second major surfaces; and at least some of said link elements in the rope chain have an irregular link thickness along the extent of said link element, whereby a cross section at one location along the extent of said link element is different in shape than a cross section at another location along the extent of said link element; wherein each of said link elements that has an irregular link thickness has at least one of its major surfaces serrated and has at least one of its interior and exterior edges serrated.

43. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

link width is defined as a distance, measured along either of said major surfaces, between a pair of parallel lines perpendicular to said major surfaces and tangent to, respectively, said interior and exterior edges;

said link elements each have a constant link width along the extent of said link elements;

link thickness is defined as a distance between and perpendicular to planes parallel to said first and second major surfaces; and at least some of said link elements in the rope chain have an irregular link thickness along the extent of said link element, whereby a cross section at one location along the extent of said link element is different in shape than a cross section at another location along the extent of said link element; wherein each of said link elements that has an irregular link thickness comprises:

a portion, or portions, of at least one of its major surfaces serrated; and a portion, or portions, of said at least one major surface not serrated.

44. A method for manufacturing a jewelry rope chain, comprising:

providing a plurality of gapped link elements, each of the gapped link elements having a first major surface, an opposite second major surface, an interior edge, and an exterior edge, at least some of said link elements having a first segment of annular shape and of a constant link width and a second segment having a link width greater than the link width of said first segment; and tightly interfitting a series of the gapped link elements to construct a rope chain having the appearance of intertwining helical strands.

45. The method as claimed in claim 44, wherein said first and second segments are made of different materials.

46. A method for manufacturing a jewelry rope chain, comprising:

providing a plurality of gapped link elements, each of the gapped link elements having a first major surface, an opposite second major surface, an interior edge, and an exterior edge, each of at least some of said link elements in the rope chain having a constant link width, link width being defined as a distance, measured along either of said major surfaces, between a pair of parallel lines perpendicular to said major surfaces and tangent to, respectively, said interior and exterior edges, and having an irregular link thickness along the extent of said link element, link thickness being defined as a distance between and perpendicular to planes parallel to said first and second major surfaces, whereby a cross section at one location along the extent of said link element is different in shape than a cross section at another location along the extent of said link element; and tightly interfitting a series of the gapped link elements to construct a length of rope chain having the appearance of intertwining helical strands; wherein:

each of said link elements that has an irregular link thickness is divided into segments, each said segment possessing a unique link thickness character relative to an adjacent segment; and each said segment is made of a different material than an adjacent segment.

47. A method for manufacturing a jewelry rope chain, comprising:

providing a plurality of gapped link elements, each of the gapped link elements having a first major surface, an opposite second major surface, an interior edge, and an exterior edge, each of at least some of said link elements in the rope chain having a constant link width, link width being defined as a distance, measured along either of said major surfaces, between a pair of parallel lines perpendicular to said major surfaces and tangent to, respectively, said interior and exterior edges, and having an irregular link thickness along the extent of said link element, link thickness being defined as a distance between and perpendicular to planes parallel to said first and second major surfaces, whereby a cross section at one location along the extent of said link element is different in shape than a cross section at another location along the extent of said link element; and tightly interfitting a series of the gapped link elements to construct a length of rope chain having the appearance of intertwining helical strands; wherein:

said gapped link elements have a generally C-shape configuration; and said gapped link element has an overall shape configuration selected from the group consisting of annular, square, oval, diamond, heart, and baguette.

48. A method for manufacturing a jewelry rope chain, comprising:

providing a plurality of gapped link elements, each of the gapped link elements having a first major surface, an opposite second major surface, an interior edge, and an exterior edge, each of at least some of said link elements in the rope chain having a constant link width, link width being defined as a distance, measured along either of said major surfaces, between a pair of parallel lines perpendicular to said major surfaces and tangent to, respectively, said interior and exterior edges, and having an irregular link thickness along the extent of said link element, link thickness being defined as a distance between and perpendicular to planes parallel to said first and second major surfaces, whereby a cross section at one location along the extent of said link element is different in shape than a cross section at another location along the extent of said link element; and tightly interfitting a series of the gapped link elements to construct a length of rope chain having the appearance of intertwining helical strands; wherein the series of tightly interfitting gapped link elements comprises combinations of differently configured gapped link elements having overall shape configurations selected from the group consisting of annular, square, oval, diamond, heart, and baguette.

49. A method for manufacturing a jewelry rope chain, comprising:

providing a plurality of gapped link elements, each of the gapped link elements having a first major surface, an opposite second major surface, an interior edge, and an exterior edge, each of at least some of said link elements in the rope chain having a constant link width, link width being defined as a distance, measured along either of said major surfaces, between a pair of parallel lines perpendicular to said major surfaces and tangent to, respectively, said interior and exterior edges, and having an irregular link thickness along the extent of said link element, link thickness being defined as a distance between and perpendicular to planes parallel to said first and second major surfaces, whereby a cross section at one location along the extent of said link element is different in shape than a cross section at another location along the extent of said link element; and tightly interfitting a series of the gapped link elements to construct a length of rope chain having the appearance of intertwining helical strands; wherein each of said link elements that has an irregular link thickness has an irregular link width.

50. A method for manufacturing a jewelry rope chain, comprising:

providing a plurality of gapped link elements, each of the gapped link elements having a first major surface, an opposite second major surface, an interior edge, and an exterior edge, each of at least some of said link elements in the rope chain having a constant link width, link width being defined as a distance, measured along either of said major surfaces, between a pair of parallel lines perpendicular to said major surfaces and tangent to, respectively, said interior and exterior edges, and having an irregular link thickness along the extent of said link element, link thickness being defined as a distance between and perpendicular to planes parallel to said first and second major surfaces, whereby a cross section at one location along the extent of said link element is different in shape than a cross section at another location along the extent of said link element; and tightly interfitting a series of the gapped link elements to construct a length of rope chain having the appearance of intertwining helical strands; wherein each of said link elements that has an irregular link thickness has a substantially C-shape configuration defining a gap, with a lateral projection on said exterior edge thereof opposite the position of the gap in the link element.

51. The method as claimed in claim 50, wherein:

said lateral projection has two adjacent bumps projecting outwardly from said exterior edge, defining a link width at a location between said bumps greater than that along the extent of said link element adjacent said lateral projection.

52. In a length of jewelry rope chain of the type comprising a series of tightly interfitting gapped link elements and having the appearance of two intertwining helical rope strands, the improvement wherein:

each of said link elements in said length of rope chain comprises a link portion exhibiting a first color, or texture, or color and texture, and another link portion exhibiting a second, different, color, or texture, or color and texture; whereby, when viewed from one side of said length of rope chain, the visual appearance of one of said helical rope strands is different, in color, or in texture, or in color and texture, than the color, or texture, or color and texture, of the other, adjacent, helical rope strand along said length of rope chain.

53. The improvement as claimed in claim 52, wherein:

said one helical rope strand is of a predetermined effective diameter; and said adjacent helical rope strand is of a different effective diameter than that of said one rope strand.

54. The improvement as claimed in claim 52, wherein:

said one helical rope strand has the shape of a helical cylindrical tube intertwined with said adjacent helical rope strand; and said adjacent helical rope strand has the shape of a helical cylindrical tube with an outer surface portion thereof cutaway along the length of said helical cylindrical tube.

55. The improvement as claimed in claim 54, wherein:

said outer surface cutaway portion of said adjacent helical rope strand is formed by a diamond cut process operating on pre-assembled link elements.

56. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

one of said major surfaces of at least some of said link elements in the length of rope chain has a plurality of spaced notches or depressions adjacent at least one of said interior and exterior edges, and has a planar center region along the extent of said link elements devoid of any notches or depressions.

57. The improvement as claimed in claim 56, wherein at least some of said link elements in the length of rope chain have the shape and configuration of a link element with at least a portion of said first major surface, or said second major surface, or both said first and second major surfaces, removed.

58. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

at least some of said link elements in the length of rope chain have the shape and configuration of a link element with at least a portion of said interior edge removed.

59. The improvement as claimed in claim 58, wherein at least some of said link elements have at least a portion of said exterior edge removed.

60. The improvement as claimed in claim 58, wherein each of said link elements that has the shape and configuration of an annular link element with at least a portion removed has a maximum link width equal to that of a similar annular link element without any portion removed.

61. The improvement as claimed in claim 58, wherein the length of rope chain has an effective maximum diameter equal to that of a similar length of rope chain constructed of annular link elements without any portion removed.

62. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

link width is defined as a distance, measured along either of said major surfaces, between a pair of parallel lines perpendicular to said major surfaces and tangent to, respectively, said interior and exterior edges;

at least some of said link elements in the length of rope chain have a non-symmetrical irregular link width along the extent of said link element;

each of said link elements that has a non-symmetrical irregular link width is divided into segments, each said segment possessing a unique link width character relative to an adjacent segment; and each of said segments is made of a different material than an adjacent segment.

63. A method for manufacturing a length of jewelry rope chain, comprising:

providing a plurality of gapped link elements, each of the gapped link elements having a first major surface, an opposite second major surface, an interior edge, and an exterior edge, and each of said link elements in said length of rope chain comprises a first link segment exhibiting a first visual property, and a second link segment exhibiting a second, different, visual property; and tightly interfitting a series of said gapped link elements to construct a rope chain having the appearance of intertwining helical rope strands; wherein, in the step of tightly interfitting said gapped link elements, said method comprises:

aligning alternate ones of said link elements in said series of link elements with their gaps facing in a predetermined direction;

aligning each link element disposed between said alternate ones of said link elements in said series of link elements with their gaps facing in a direction opposite said predetermined direction;

orienting each link element in said series of link elements with its first link segment juxtaposed to the first link segment of the next adjacent link element; and orienting each link element in said series of link elements with its second link segment juxtaposed to the second link segment of the next adjacent link element; whereby when viewed from one side of said length of rope chain, the visual appearance of one of said helical rope strands is different than the visual appearance of the other, adjacent, helical rope strand along said length of rope chain.

64. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

each of at least some of said link elements in the length of rope chain is divided into half-link segments;

one of said half-link segments has a surface exhibiting a first visual property of color, or texture, or a combination of color and texture; and the other of said half-link segments has a surface exhibiting a second visual property of color, or texture, or a combination of color and texture, uniquely different from that of said first half-link segment.

65. The improvement as claimed in claim 64, wherein at least a portion of one of said first major surface, second major surface, interior edge, and exterior edge, of each of said link elements that exhibits irregular visual properties, is textured in the form of at least one of the group consisting of a serrated surface, a sandblasted surface, a series of angled plate-like surfaces having a saw-toothed profile, V-shaped grooved surface, and a diamond cut surface.

66. The improvement as claimed in claim 64, wherein:

each said segment is made of a different material than an adjacent segment.

67. The improvement as claimed in claim 64, wherein:

said link elements have a generally C-shape configuration; and said series of tightly interfitting gapped link elements comprises combinations of differently configured gapped link elements having overall shape configurations selected from the group consisting of annular, square, oval, diamond, heart, and baguette.

68. The improvement as claimed in claim 64, wherein each of said link elements that exhibits an irregular visual property along its extent has a repeating pattern of said visual property variation along its extent.

69. The improvement as claimed in Claim 64, wherein:

one of said segments is one color, or texture, and of one shape; and another of said segments is another color, or texture, and of another shape.

70. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

the interior edge of at least some of said link elements in said length of jewelry rope chain has at least one notch formed therein.

71. The improvement as claimed in claim 70, wherein at least a portion of one of said first major surface, second major surface, interior edge, and exterior edge, of each of said link elements that has a notched interior edge, is textured in the form of at least one of the group consisting of a serrated surface, a sandblasted surface, a series of angled plate-like surfaces having a saw-toothed profile, V-shaped grooved surface, and a diamond cut surface.

72. The improvement as claimed in claim 70, wherein:

each of said link elements with a notched interior edge has a crenelated interior edge.

73. The improvement as claimed in claim 72, wherein each of said link elements with a crenelated interior edge has an exterior edge configured in the shape of a heart.

74. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

at least some of said link elements in said length of jewelry rope chain are divided into segments; and each said segment is made of a different material than an adjacent segment along the extent of each such link element.

75. The improvement as claimed in claim 74, wherein at least a portion of one of said first major surface, second major surface, interior edge, and exterior edge, of each of said link elements that is divided into segments, is textured in the form of at least one of the group consisting of a serrated surface, a sandblasted surface, a series of angled plate-like surfaces having a saw-toothed profile, V-shaped grooved surface, and a diamond cut surface.

76. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

link width is defined as a distance, measured along either of said major surfaces, between a pair of parallel lines perpendicular to said major surfaces and tangent to, respectively, said interior and exterior edges;

at least some of said link elements in the length of rope chain have the shape and configuration of a C-shaped link element divided into segments, a first one of said segments having a predetermined maximum link width and multiple surface recesses formed therein in a repeated pattern, and a second one of said segments having a continuous and constant link width intact and undisturbed.

77. The improvement as claimed in claim 76, wherein at least a portion of one of said first major surface, second major surface, interior edge, and exterior edge, of each of said link elements that has a portion removed, is textured in the form of at least one of the group consisting of a serrated surface, a sandblasted surface, a series of angled plate-like surfaces having a saw-toothed profile, V-shaped grooved surface, and a diamond cut surface.

78. The length of jewelry rope chain as claimed in claim 76, wherein said maximum link width of said first segment is less than the constant link width of said second segment.

79. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

link width is defined as a distance, measured along either of said major surfaces, between a pair of parallel lines perpendicular to said major surfaces and tangent to, respectively, said interior and exterior edges;

at least some of said link elements in the length of rope chain have an irregular link width along the extent of said link element;

each of said link elements that has an irregular link width is divided into segments; and one of said segments has an arcuate interior edge and undulations on its exterior edge, said undulations having peaks lying in an arc.

80. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

link width is defined as a distance, measured along either of said major surfaces, between a pair of parallel lines perpendicular to said major surfaces and tangent to, respectively, said interior and exterior edges;

at least some of said link elements in the length of rope chain have an irregular link width along the extent of said link element; and each of said link elements that has an irregular link width has an arcuate concave cutout formed in said exterior edge.

81. The improvement as claimed in claim 80, wherein said faceted arcuate concave cutout is defined by a plurality of stepped surfaces along the extent of the cutout.

82. In a length of jewelry rope chain of the type comprising a series of tightly interfitting gapped link elements and having the appearance of intertwining helical strands, each of said gapped link elements having a first major surface, an opposite second major surface, an interior edge, and an exterior edge, the improvement wherein:

link width is defined as a distance, measured along either of said major surfaces, between a pair of parallel lines perpendicular to said major surfaces and tangent to, respectively, said interior and exterior edges; and at least some of said link elements in the length of rope chain have an irregular link width along the extent of said link element; and each of said link elements that have an irregular link width has a textured cutout formed in the exterior edge thereof.

* * * * *